US007971981B2

(12) United States Patent
Nagashima et al.

(10) Patent No.: US 7,971,981 B2
(45) Date of Patent: Jul. 5, 2011

(54) LIQUID CIRCULATION APPARATUS, IMAGE FORMING APPARATUS AND LIQUID CIRCULATION METHOD

(75) Inventors: Kanji Nagashima, Kanagawa-ken (JP); Tadashi Kyoso, Kanagawa-ken (JP); Tsutomu Kusakari, Kanagawa-ken (JP)

(73) Assignee: FujiFilm Corporation, Tokyo (JP)

( * ) Notice: Subject to any disclaimer, the term of this patent is extended or adjusted under 35 U.S.C. 154(b) by 746 days.

(21) Appl. No.: 12/057,209

(22) Filed: Mar. 27, 2008

(65) Prior Publication Data

US 2008/0238980 A1 Oct. 2, 2008

(30) Foreign Application Priority Data

Mar. 30, 2007 (JP) ..... 2007-095507

(51) Int. Cl.
*B41J 2/18* (2006.01)

(52) U.S. Cl. ..... 347/89; 347/17; 347/68; 347/85

(58) Field of Classification Search ..... 347/85–87, 347/89–90, 17, 68
See application file for complete search history.

(56) References Cited

U.S. PATENT DOCUMENTS

| | | | | |
|---|---|---|---|---|
| 4,929,256 | A | 5/1990 | Shepherd | |
| 6,582,066 | B1 | 6/2003 | Temple | |
| 6,705,704 | B2 | 3/2004 | Harvey et al. | |
| 2003/0011668 | A1* | 1/2003 | Yoshida | 347/86 |
| 2003/0016256 | A1 | 1/2003 | Harvey et al. | |
| 2008/0136860 | A1* | 6/2008 | Kyoso | 347/19 |
| 2008/0198207 | A1* | 8/2008 | Katada | 347/85 |
| 2008/0211841 | A1* | 9/2008 | Kojima et al. | 347/9 |
| 2008/0238980 | A1* | 10/2008 | Nagashima et al. | 347/17 |
| 2008/0309739 | A1* | 12/2008 | Takahashi | 347/85 |

FOREIGN PATENT DOCUMENTS

| | | | |
|---|---|---|---|
| EP | 0 309 146 | A2 | 3/1989 |
| JP | 63-41152 | A | 2/1988 |
| JP | 1-108056 | A | 4/1989 |
| JP | 2000-512233 | A | 9/2000 |
| JP | 2003-505281 | A | 2/2003 |
| WO | WO-98/52763 | A2 | 11/1998 |
| WO | WO-01/08888 | A1 | 2/2001 |

* cited by examiner

*Primary Examiner* — Ellen Kim
(74) *Attorney, Agent, or Firm* — Birch, Stewart, Kolasch & Birch, LLP

(57) ABSTRACT

A liquid circulation apparatus includes: a plurality of liquid ejection elements each of which includes a nozzle, a pressure chamber which is connected to the nozzle and accommodates liquid, and a piezoelectric element which displaces a wall of the pressure chamber to eject the liquid in the pressure chamber through the nozzle; a plurality of individual supply channels which are respectively connected to the liquid ejection elements; a common supply channel which is connected to the individual supply channels, the liquid being supplied from the common supply channel to the liquid ejection elements through the individual supply channels; a plurality of individual circulation channels which are respectively connected to the liquid ejection elements; a common circulation channel which is connected to the individual circulation channels, the liquid being circulated from the liquid ejection elements to the common circulation channel through the individual circulation channels; and a control device which controls a circulation volume of the liquid circulated from the liquid ejection elements to the common circulation channel, by adjusting a supply volume of the liquid supplied from the common supply channel to the liquid ejection elements in accordance with an ejection volume of the liquid ejected from the liquid ejection elements.

17 Claims, 18 Drawing Sheets

LIQUID CIRCULATION APPARATUS, IMAGE FORMING APPARATUS AND LIQUID CIRCULATION METHOD

BACKGROUND OF THE INVENTION

1. Field of the Invention

The present invention relates to a liquid circulation apparatus, an image forming apparatus and a liquid circulation method, and more particularly, to technology for circulating liquid in the vicinity of a plurality of nozzles of a liquid ejection head which ejects ink droplets from the nozzles.

2. Description of the Related Art

An inkjet recording apparatus has been known which performs recording by ejecting ink droplets toward a recording medium from a plurality of nozzles which are formed in an inkjet head (hereinafter, called a "recording head" or simply "head"). The inkjet recording apparatus has been commonly used because of its little noise during operation, low running cost and capability of recording a high quality image on a wide variety of recording medium. The ink ejection method may be a piezoelectric method in which ink droplets are ejected from nozzles by utilizing the displacement of piezoelectric elements to pressurize the ink inside pressure chambers, or a thermal method in which ink droplets are ejected from nozzles due to the pressure created by the growth of gas bubbles which are generated inside pressure chambers by means of the thermal energy created by heating elements, such as heaters, or the like.

In an inkjet recording method, if an ink having a solvent that is liable to evaporate at the operational temperature and humidity conditions is used (for example, an ink which uses water as a solvent, or the like), then during printing and during standby for printing, a phenomenon occurs whereby the solvent in the ink evaporates from the nozzles, the concentration of solvent in the ink in the vicinity of the nozzles becomes lower, and the viscosity of the ink rises. When the ink viscosity in the vicinity of the nozzles rises, then the fluid resistance inside the nozzles becomes greater, and ejection defects arise due to the occurrence of variations in the volume of the ejected ink droplets or in the direction of flight of the droplets, or ejection failures may occur. Consequently, this may give rise to displacement of the dot positions on the print medium, error in the size of the dots, and omission of dots.

If this situation proceeds further, then it becomes impossible to perform ejection completely, and maintenance known as "nozzle cleaning" becomes necessary.

In response to this, according to experimentation carried out by the present inventors and others, it has been confirmed that in a state where no particular countermeasures are implemented, then in the case of an ink which uses water as a solvent, the solvent starts to evaporate from the nozzles and within five or six seconds, ejection defects arise and extremely serious problems occur even under conditions of normal temperature and normal pressure.

In order to prevent this problem, in a piezoelectric type of head which uses an actuator (piezoelectric element), such as a piezo element, a vibration of a level which does not cause ejection of ink from the nozzles is also applied to the ink in the non-ejecting nozzles (non-operational nozzles) which are not performing ink ejection. The ink in the vicinity of the nozzles is thereby mixed up with the ink inside the pressure chambers, and the fall in the solvent concentration of the ink in the nozzle sections is restricted. Thus, control is implemented which suppresses increase in the viscosity of the ink in the nozzle sections. Below, control of this kind is called "meniscus shaking".

However, even with this method, if a long period of time elapses, then there is a decline in the concentration of ink solvent in the whole of the pressure chambers and the nozzle sections, and consequently, this can lead to ejection defects. Therefore, before ejection defects arise, the ink in the whole of the pressure chambers needs to be expelled by dummy ejection or by a suctioning operation, and needs to be replaced with fresh ink.

In a head based on a thermal method in which it is difficult to mix up the ink by applying a vibration of a level that does not cause ejection, to the ink, as described above, the ejection force is inherently a strong force, and therefore it takes a long time until ejection defects such as those described above arise. However if left without taking any particular countermeasures, ejection defects will arise, and therefore control is implemented in a similar fashion in order to expel ink which has risen in viscosity in the vicinity of the nozzles.

Furthermore, a method has also been adopted in a thermal type of head, whereby ink is circulated through a common flow channel, the volume of the pressure chambers is made as small as possible, and the distance between the common flow channel and the nozzles is shortened, in such a manner that decline in the solvent concentration of the ink in the vicinity of the nozzles is delayed by the effects of the diffusion of solvent from the common flow channel. However, in order completely to prevent increase in the viscosity of the ink in the vicinity of the nozzles by means of this method, it is necessary for the length from the supply path to the nozzle, via the pressure chamber, to be no more than several tens of microns, and therefore, in practice, the increase in viscosity is not suppressed completely, and control for expelling ink of raised viscosity is still needed.

In inkjet printers using either of the aforementioned kinds of actuator, printing cannot be carried out while ink is being expelled, and therefore, the ink of raised viscosity is expelled by moving the head to a position that is distanced from the printing region, or alternatively, if the print medium is a cut paper, or the like, ink is expelled by providing a medium for receiving the ink expelled in the interval between respective sheets of the print medium.

In other words, it is not possible to prevent increase in the viscosity of the ink due to evaporation of the solvent, either by shaking the meniscus, or by employing a diffusion effect by reducing the volume of the pressure chambers, or the like, and therefore ink of raised viscosity is required to be expelled and discarded, giving rise to wasted ink.

Even if this ink is reused rather than being discarded, a filtering process is required since there is a high probability that dust, or the like, will have entered into the ink having been expelled from the nozzles.

Since it is essentially impossible to carry out printing during the expulsion of ink, whichever of the printing systems described above is adopted, then there is a problem in that productivity declines.

In response to problems of this kind, technology has been proposed for preventing decline in the concentration of ink solvent in the vicinity of nozzles by constantly circulating the ink in non-ejecting nozzles and ejecting nozzles, during printing (see, for example, Japanese Patent Application Publication No. 63-41152, Japanese Patent Application Publication No. 1-108056, Publication of Japanese translation of PCT Application No. 2000-512233 and Publication of Japanese translation of PCT Application No. 2003-505281.)

However, there are problems of the following kinds associated with these ink circulation technologies in the related art.

(1) If it is sought to maintain a good printing state for all of the printing conditions, then this implies the most severe conditions in terms of the volume of circulated ink, and therefore the total volume of reused ink after circulation becomes very large, and the amount of added solvent also becomes large.

(2) If a filter is used to deal with any possible infiltration of foreign matter, then the lifespan of the filter is very short.

(3) In the case of UV-curable ink, if circulation is continued then the ink becomes less readily curable, due to the effects of the oxygen and moisture in the air (in the case of a radical type of UV-curable ink, the presence of oxygen causes the radicals to be captured by the oxygen, thereby inhibiting the curing reaction, and in the case of a cationically-curable ink, the presence of moisture makes curing difficult to achieve). Furthermore, the ink is degraded and may become unrecoverable (irreversibly changed), due to chemical changes caused by the effects of heating due to the temperature adjustment of the head, or light of trace levels, or the like.

(4) Since air becomes dissolved in the ink that makes contact with the air in the nozzle sections, then if the circulation volume is high, the amount of dissolved air in the ink increases, the compliance of the ink changes, and the ejection characteristics hence change. Moreover, the time taken for the air bubbles to disappear also becomes longer in the event that air bubbles do enter into the ink, and the restoration time for the effects caused by the air bubbles becomes longer.

Consequently, it is desirable for the amount of circulated ink to be as small as possible.

SUMMARY OF THE INVENTION

The present invention has been contrived in view of the circumstances described above, an object thereof being to provide a liquid circulation apparatus, an image forming apparatus and a liquid circulation method whereby ejection defects are prevented by circulating the ink in the vicinity of the nozzles, as well as being able to reduce the circulated ink volume which is recycled or discarded.

In order to attain the aforementioned object, the present invention is directed to a liquid circulation apparatus, comprising: a plurality of liquid ejection elements each of which includes: a nozzle; a pressure chamber which is connected to the nozzle and accommodates liquid; and a piezoelectric element which displaces a wall of the pressure chamber to eject the liquid in the pressure chamber through the nozzle; a plurality of individual supply channels which are respectively connected to the liquid ejection elements; a common supply channel which is connected to the individual supply channels, the liquid being supplied from the common supply channel to the liquid ejection elements through the individual supply channels; a plurality of individual circulation channels which are respectively connected to the liquid ejection elements; a common circulation channel which is connected to the individual circulation channels, the liquid being circulated from the liquid ejection elements to the common circulation channel through the individual circulation channels; and a control device which controls a circulation volume of the liquid circulated from the liquid ejection elements to the common circulation channel, by adjusting a supply volume of the liquid supplied from the common supply channel to the liquid ejection elements in accordance with an ejection volume of the liquid ejected from the liquid ejection elements.

In this aspect of the present invention, the liquid circulation volume is controlled by adjusting the liquid supply volume in accordance with the liquid ejection volume of the plurality of liquid droplet ejection elements. By this means, when the liquid ejection volume is low, it is possible to increase the liquid circulation volume and thereby prevent ejection defects caused by increase in the viscosity of the liquid in the vicinity of the nozzles. On the other hand, when the liquid ejection volume is high, then by lowering the liquid circulation volume (and desirably, reducing the liquid circulation volume to zero), the liquid inside the common circulation channel is caused to return to the ejecting nozzle side by the liquid ejection operation at the ejecting nozzle, and this liquid is ejected from the ejecting nozzle. At the same time, a flow of liquid is also created from the non-ejecting nozzles towards the common circulation channel, and therefore it is possible to prevent ejection defects in the non-ejecting nozzles. Consequently, the amount of circulated liquid that is to be recycled or discarded can be reduced, and costs can be reduced.

Preferably, the control device adjusts the supply volume by changing a pressure differential of the liquid between in the common supply channel and in the common circulation channel.

In this aspect of the present invention, it is possible to simplify the control of the liquid circulation volume.

Preferably, the control device adjusts the supply volume to be greater than the ejection volume when the ejection volume is smaller than a prescribed value, and adjusts the supply volume to be equal to the ejection volume when the ejection volume is greater than the prescribed value.

Since the liquid circulation volume is reduced to zero when the liquid supply volume is greater than the prescribed value, the volume of circulated ink that is to be recycled or discarded can be reduced, and therefore further cost savings can be achieved.

In this aspect of the present invention, the "prescribed value" may be the minimum ejection volume required to prevent ejection defects in the nozzles, or it may be a volume which is larger than the minimum required ejection volume by a prescribed margin.

Preferably, when the ejection volume is smaller than the prescribed value, the control device keeps the supply volume constant regardless of the ejection volume.

Preferably, when the ejection volume is smaller than the prescribed value, the control device adjusts the supply volume to increase gradually as the ejection volume increases.

Preferably, the control device adjusts the supply volume to be greater than the ejection volume but to approach the ejection volume gradually as the ejection volume increases.

In this aspect of the present invention, the differential between the liquid supply volume and the liquid ejection volume can be controlled to be inversely proportional to the number of printed dots, for example. Accordingly, the control procedure can be simplified.

Preferably, each of the liquid ejection elements further includes a nozzle channel which connects the pressure chamber with the nozzle; one of the individual supply channels is connected to the pressure chamber; and one of the individual circulation channels has an opening end which opens to the nozzle channel.

In this aspect of the present invention, it is possible effectively to prevent ejection defects caused by increase in the viscosity of the liquid in the vicinity of the nozzles.

Preferably, each of the liquid ejection elements further includes a nozzle channel which connects the pressure chamber with the nozzle; one of the individual supply channels has an opening end which opens to the nozzle channel; and one of the individual circulation channels is connected to the pressure chamber.

In this aspect of the present invention, it is possible to prevent ejection defects caused by increase in the viscosity of the liquid in the vicinity of the nozzles, and it is also possible to achieve faster refilling of the liquid.

Preferably, the nozzle channel has a flow speed regulating section between the pressure chamber and the opening end of the one of the individual circulation channels, the nozzle channel tapering in the flow speed regulating section toward the nozzle.

Preferably, the nozzle channel has a flow speed regulating section between the pressure chamber and the opening end of the one of the individual supply channels, the nozzle channel tapering in the flow speed regulating section toward the nozzle.

In these aspects of the present invention, it is possible to achieve a flow speed distribution which is substantially symmetrical in terms of the nozzle axis, in the liquid flowing through the nozzle flow channel.

Preferably, the nozzle channel is defined by an inner surface having a plurality of openings including the opening end of the one of the individual circulation channels, the openings being arranged at positions that are rotationally-symmetric in terms of an axis of the nozzle.

Preferably, the nozzle channel is defined by an inner surface having a plurality of openings including the opening end of the one of the individual supply channels, the openings being arranged at positions that are rotationally-symmetric in terms of an axis of the nozzle.

In these aspects of the present invention, it is possible to achieve a flow speed distribution which is substantially symmetrical about the nozzle axis, in the liquid flowing through the nozzle flow channel.

Preferably, each of the individual flow channels has a branching section which has a first end connected to the common circulation channel and a second end connected to at least two of the liquid ejection elements.

In this aspect of the present invention, it is possible effectively to suppress increase in the viscosity of the liquid in the pressure chambers.

In order to attain the aforementioned object, the present invention is also directed to a liquid circulation apparatus, comprising: a plurality of pairs of first and second liquid ejection elements, each of the first and second liquid ejection elements including: a nozzle; a pressure chamber which is connected to the nozzle and accommodates liquid; and a piezoelectric element which displaces a wall of the pressure chamber to eject the liquid in the pressure chamber through the nozzle; a plurality of first individual supply channels which are respectively connected to the first liquid ejection elements; a first common supply channel which is connected to the first individual supply channels; a plurality of second individual supply channels which are respectively connected to the second liquid ejection elements; a second common supply channel which is connected to the second individual supply channels; a plurality of individual circulation channels each of which connects the first and second liquid ejection elements with each other in one of the pairs of the first and second liquid ejection elements; and a control device which controls a pressure differential of the liquid between in the first common channel and in the second common channel according to an ejection volume of the liquid ejected from the liquid ejection elements.

In this aspect of the present invention, it is possible to circulate liquid between the first and second liquid droplet ejection elements, via the circulation flow channels, by changing the pressure differential between the first and second common flow channels in accordance with the liquid ejection volume from the plurality of liquid droplet ejection elements. Consequently, the liquid of increased viscosity in the vicinity of the non-ejecting nozzles can be circulated towards the ejecting nozzles, and can be ejected from the ejecting nozzles, and therefore it is possible to reduce the volume of circulated liquid that is to be recycled or discarded, and cost savings can be made.

In order to attain the aforementioned object, the present invention is also directed to an image forming apparatus including one of the liquid circulation apparatuses as described above.

In this aspect of the present invention, it is possible to improve the image quality without causing ejection defects in the nozzles.

In order to attain the aforementioned object, the present invention is also directed to a liquid circulation method for a liquid circulation apparatus which includes: a plurality of liquid ejection elements each of which includes a nozzle, a pressure chamber which is connected to the nozzle and accommodates liquid, and a piezoelectric element which displaces a wall of the pressure chamber to eject the liquid in the pressure chamber through the nozzle; a plurality of individual supply channels which are respectively connected to the liquid ejection elements; a common supply channel which is connected to the individual supply channels, the liquid being supplied from the common supply channel to the liquid ejection elements through the individual supply channels; a plurality of individual circulation channels which are respectively connected to the liquid ejection elements; and a common circulation channel which is connected to the individual circulation channels, the liquid being circulated from the liquid ejection elements to the common circulation channel through the individual circulation channels, the method comprising the steps of: determining an ejection volume of the liquid ejected from the liquid ejection elements; and controlling a circulation volume of the liquid circulated from the liquid ejection elements to the common circulation channel, by adjusting a supply volume of the liquid supplied from the common supply channel to the liquid ejection elements in accordance with the ejection volume determined in the determining step.

According to the present invention, the liquid circulation volume is controlled by adjusting the liquid supply volume in accordance with the liquid ejection volume of the plurality of liquid droplet ejection elements. By this means, when the liquid ejection volume is low, it is possible to increase the liquid circulation volume and thereby prevent ejection defects caused by increase in the viscosity of the liquid in the vicinity of the nozzles. On the other hand, when the liquid ejection volume is high, then by lowering the liquid circulation volume (and desirably, reducing the liquid circulation volume to zero), the liquid inside the common circulation channel is caused to return to the ejecting nozzle side by the liquid ejection operation at the ejecting nozzle, and this liquid is ejected from the ejecting nozzle. At the same time, a flow of liquid is also created from the non-ejecting nozzles towards the common circulation channel, and therefore it is possible to prevent ejection defects in the non-ejecting nozzles. Consequently, the amount of circulated liquid that is to be recycled or discarded can be reduced, and costs can be reduced.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

First Embodiment

General Composition of Inkjet Recording Apparatus

Figure 1:
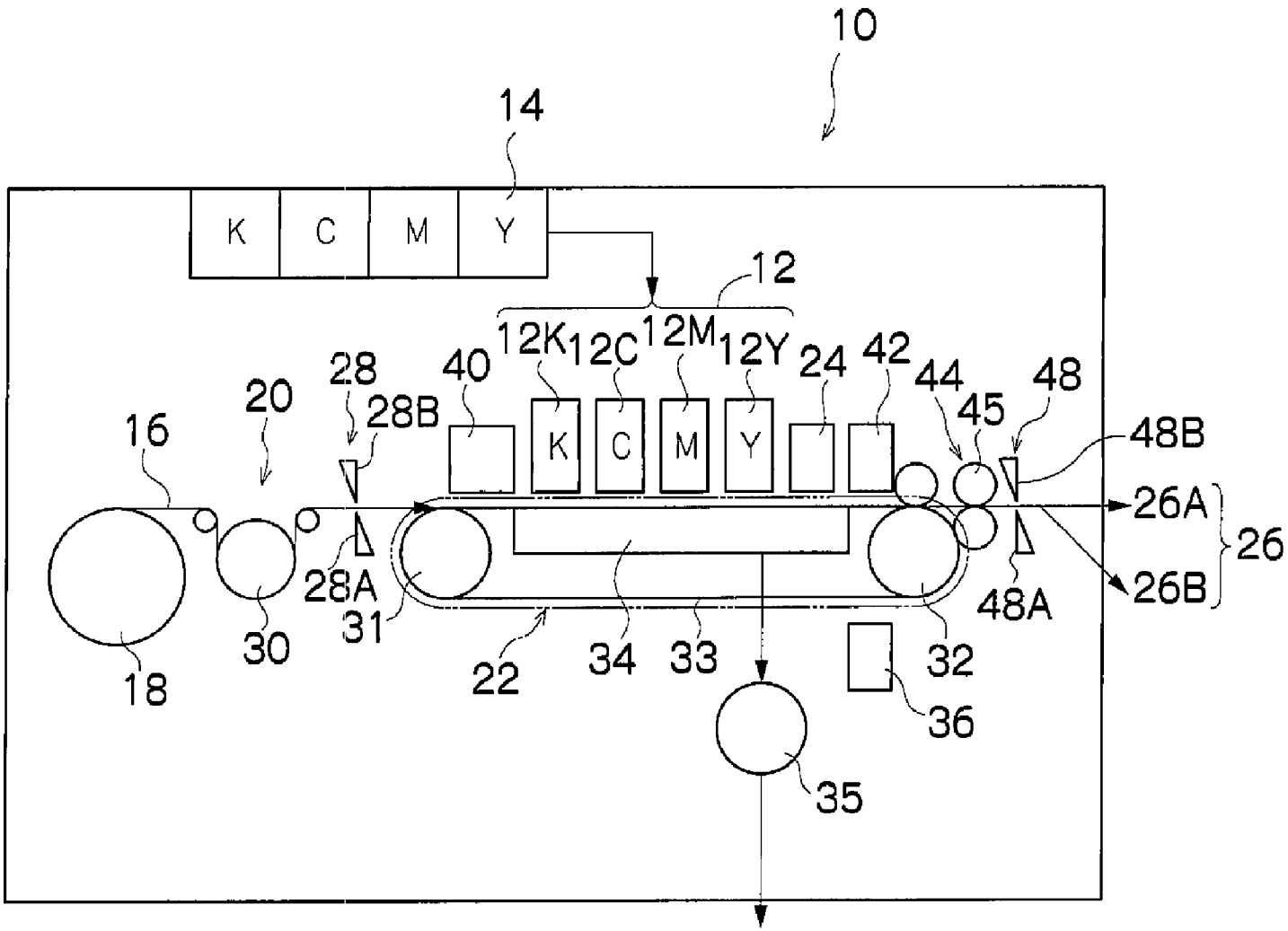
FIG. 1 is a general schematic drawing showing a general view of an inkjet recording apparatus.

Firstly, an inkjet recording apparatus which forms an image forming apparatus according to an embodiment of the present invention will be described. FIG. 1 is a general schematic drawing showing a general view of an inkjet recording apparatus according to an embodiment of the present invention. As shown in FIG. 1, the inkjet recording apparatus 10 comprises: a print unit 12 having a plurality of recording heads 12K, 12C, 12M, and 12Y for ink colors of black (K), cyan (C), magenta (M), and yellow (Y), respectively; an ink storing and loading unit 14 for storing inks of K, C, M and Y to be supplied to the recording heads 12K, 12C, 12M, and 12Y; a paper supply unit 18 for supplying recording paper 16; a decurling unit 20 for removing curl in the recording paper 16; a suction belt conveyance unit 22 disposed facing ink-droplet ejection face (the nozzle face) of the print unit 12, for conveying the recording paper 16 while keeping the recording paper 16 flat; a print determination unit 24 for reading the printed result produced by the print unit 12; and a paper output unit 26 for outputting image-printed recording paper (printed matter) to the exterior.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of the configuration in which roll paper is used, a cutter 28 is provided as shown in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut papers are used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the ink ejection face of the print unit 12 and the sensor face of the print determination unit 24 forms a plane.

The belt 33 has a width that is greater than the width of the recording paper 16, and a plurality of suction restrictors (not shown) are formed on the belt surface. A suction chamber 34 is disposed in a position facing the sensor surface of the print determination unit 24 and the ink ejection surface of the print unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the bet 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the print unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The print unit 12 is a so-called "full line head" in which a line head having a length corresponding to the maximum paper width is arranged in a direction (main scanning direction) that is perpendicular to the paper conveyance direction (sub scanning direction).

Figure 2:
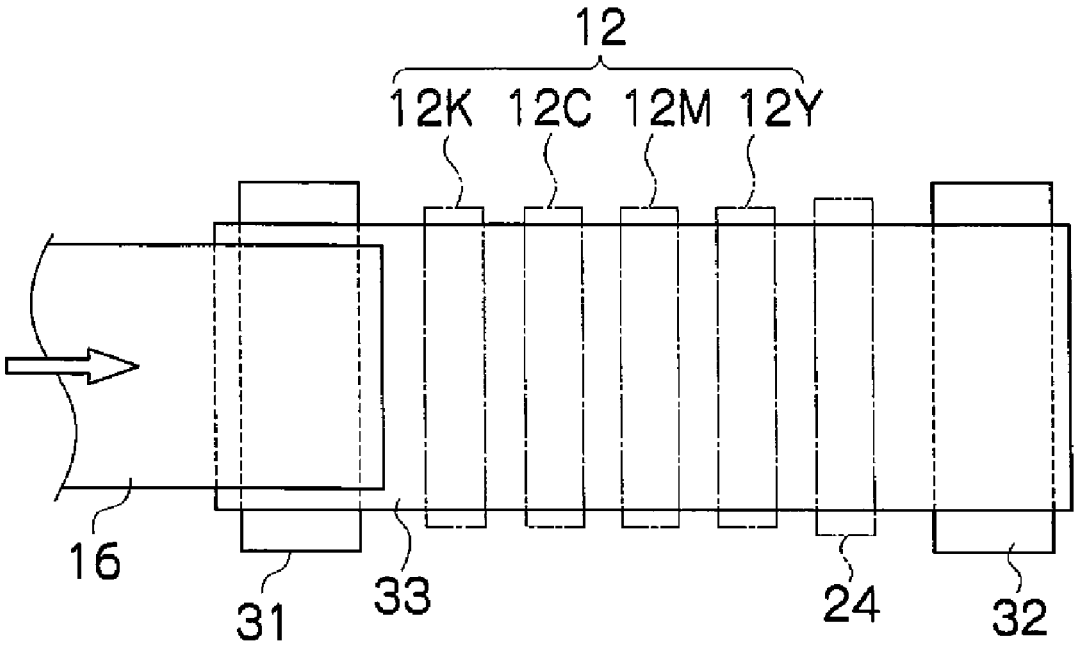
FIG. 2 is a principal plan diagram showing the peripheral area of a print unit of an inkjet recording apparatus.

The recording respective heads 12K, 12C, 12M, and 12Y forming the print unit 12 is constituted by a line head, in which a plurality of ink ejection ports (nozzles) are arranged along a length that exceeds at least one side of the maximum-size recording paper 16 intended for use in the inkjet recording apparatus 10 (see FIG. 2).

The recording heads 12K, 12C, 12M, and 12Y are arranged in the order of black (K), cyan (C), magenta (M), and yellow (Y) from the upstream side (left-hand side in FIG. 1), along the conveyance direction of the recording paper 16 (paper conveyance direction). A color image can be formed on the recording paper 16 by ejecting the inks from the recording heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relative to each other in the paper conveyance direction (sub-scanning direction) just once (in other words, by means of a single sub-scan). Higher-speed printing is thereby made possible and productivity can be improved in comparison with a shuttle type head configuration in which a recording head moves reciprocally in the direction (main-scanning direction) that is perpendicular to the paper conveyance direction.

Although the configuration with the KCMY four standard colors is described in the present embodiment, combinations of the ink colors and the number of colors are not limited to those. Light inks and dark inks can be added as required. For example, a configuration is possible in which the recording heads for ejecting light-colored inks such as light cyan and light magenta are added. Furthermore, there are no particular restrictions of the sequence in which the heads of respective colors are arranged.

As shown in FIG. 1, the ink storing and loading unit 14 has ink tanks for storing the inks of the colors corresponding to the respective recording heads 12K, 12C, 12M, and 12Y, and the respective tanks are connected to the recording heads 12K, 12C, 12M, and 12Y by means of channels (not shown). The ink storing and loading unit 14 has a warning device (for example, a display device or an alarm sound generator) for warning when the remaining amount of any ink is low, and has a mechanism for preventing loading errors among the colors.

The print determination unit 24 has an image sensor (line sensor, and the like) for capturing an image of the ink-droplet deposition result of the print unit 12, and functions as a device to check for ejection defects such as clogs of the nozzles in the print unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the recording heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the recording heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24, The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B. Although not shown in FIG. 1, the paper output unit 26A for the target prints is provided with a sorter for collecting prints according to print orders.

The structure of a print head will be described. The print heads 12K, 12C, 12M and 12Y of the respective ink colors have the same structure, and a reference numeral 50 is hereinafter designated to any of the print heads.

Composition of Ink Circulation System

Next, the ink circulation system of the inkjet recording apparatus 10 will be described.

Figure 3:
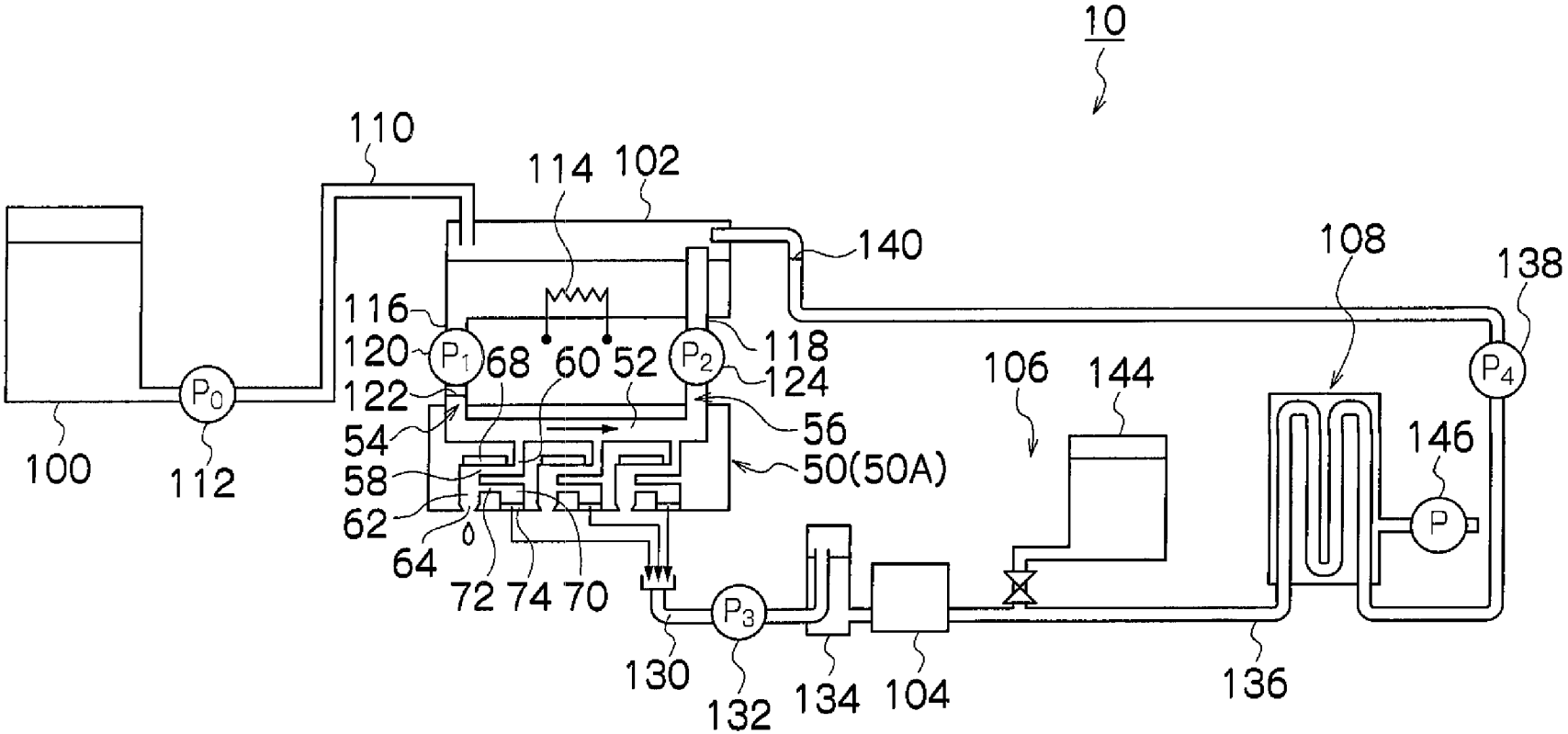
FIG. 3 is a schematic drawing showing an ink circulation system of an inkjet recording apparatus.

FIG. 3 is a schematic drawing showing an ink circulation system of an inkjet recording apparatus. As shown in FIG. 3, the ink circulation system of the inkjet recording apparatus 10 is principally constituted of a recording head 50 (50A), an ink tank 100, a sub tank 102, a solvent concentration detector 104, a solvent addition apparatus 106, and a deaeration apparatus 108. Ink is supplied to the recording head 50 from the ink tank 100 and via the sub tank 102, and ink droplets are ejected respectively from the plurality of nozzles 64 which are formed in the recording head 50, in addition to which, a portion of the ink supplied to the recording head 50 is circulated inside the head and returned to the sub tank 102. Below, the composition of the respective sections will be described.

A pump 112 is provided in the flow channel 110 which connects the ink tank 100 with the sub tank 102. The ink inside the ink tank 100 is supplied to the sub tank 102 by means of the pump 112. The pump 112 is controlled in such a manner that the amount of ink inside the sub tank 102 is uniform. A heater and cooler for ink temperature adjustment 114 is provided in the sub tank 102, and by adjusting the temperature of the ink inside the sub tank 102 to a prescribed temperature, by means of this heater and cooler for ink temperature adjustment 114, the viscosity of the ink is maintained at a uniform value. For example, there is a mode in which a temperature sensor (not illustrated) for determining the temperature of the ink inside the recording head 50 is provided, and the heater and cooler for ink temperature adjustment 114 is controlled in such a manner that the temperature of the ink inside the recording head 50 assumes a prescribed temperature (for example, 55° C.) (in other words, in such a manner that the ink assumes a desired viscosity).

The sub tank 102 and the recording head 50 are connected with each other by means of a first flow channel 116 and a second flow channel 118. The first flow channel 116 is connected via a first supply port 54 which is formed at one end of a common flow channel (common supply channel) 52 formed in the recording head 50, and the second flow channel 118 is connected via a second supply port 56 which is formed at the other end of the common flow channel 52. The first flow channel 116 is an individual supply channel for supplying ink to the recording head 50 from the sub tank 102, and it is provided with a pump 120 and a filter 122. On the other hand, the second flow channel 118 is a circulation flow channel for returning a portion of the ink supplied to the recording head 50, to the sub tank 102, and it is provided with a pump 124.

The ink inside the sub tank 102 is supplied from the first flow channel 116, via a filter 122, to the recording head 50, by the action of the pump 120. It is preferable that the fineness (mesh size) of the filter 122 should be smaller than the nozzle diameter, since this makes it possible to prevent in advance any blockages in the nozzles caused by foreign material which has entered into the recording head 50 from the sub tank 102. For example, a filter having a mesh size that is smaller than the nozzle diameter by about 10% is used.

A portion of the ink supplied to the recording head 50 is returned from the second flow channel 118 to the sub tank 102, via the common flow channel 52, by the pump 124. Although not shown in the drawing, there is also a mode in which a vacuum deaeration apparatus is installed in the second flow channel 118, to the upstream side of the pump 124 (the side of the recording head 50).

Nozzle flow channels 62 which are connected to the nozzles 64 are provided respectively for the pressure chambers 58 which are connected to the common flow channel 52. An individual circulation channel 72 is provided in each nozzle flow channel 62, and the nozzle flow channel 62 is connected via this individual circulation channel 72 to a common circulation channel 70. The common circulation channel 70 is connected to collection ports 74 via a connecting flow channel (not illustrated here, but indicated with reference numeral 71 in FIG. 6), and the collection ports 74 are connected to a pump 132 through a flow channel 130.

Figure 4:
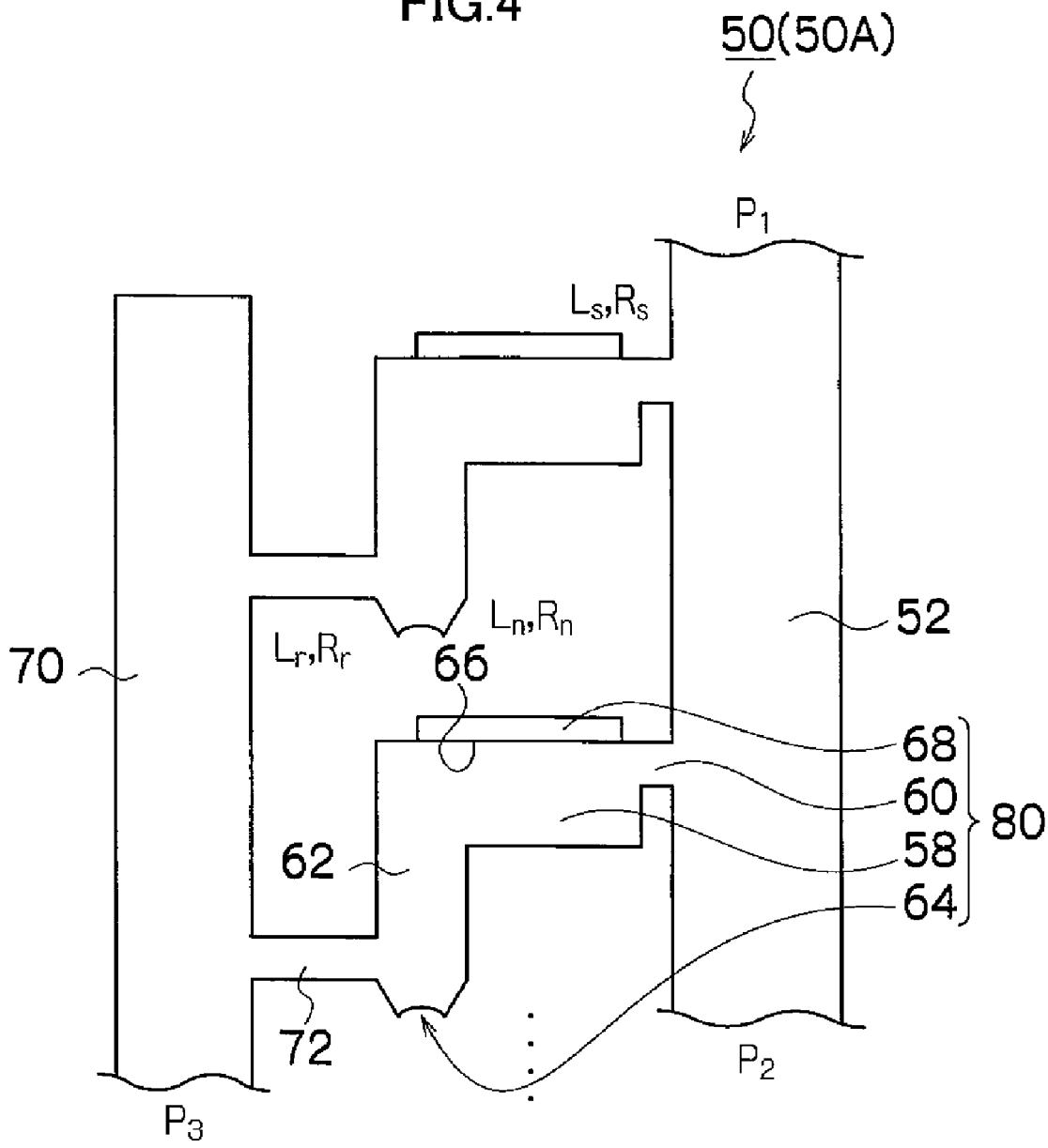
FIG. 4 is a schematic drawing showing one example of the internal structure of a recording head.

FIG. 4 is a schematic drawing showing one example of the internal structure of the recording head 50. As shown in FIG. 4, a plurality of liquid droplet ejection elements 80 are provided in the recording head 50, each liquid droplet ejection element 80 comprising a nozzle 64 forming an ink droplet ejection port, a pressure chamber 58, an individual supply channel 60, and a piezoelectric element 68 which causes the deformation of a diaphragm 66 that constitutes a wall of the pressure chamber 58. The detailed composition of the recording head 50 is described hereinafter, but the recording head 50 is composed by aligning a plurality of head units each of which has a plurality of liquid droplet ejection elements 80 that are arranged in a matrix configuration (two-dimensional configuration).

The pressure chambers 58 are connected to the common flow channel 52 via individual supply channels 60, respectively. The ink is supplied from the common flow channel 52 to each of the pressure chambers 58 via a corresponding one of the individual supply channels 60. The individual supply channels 60 also function as supply restrictors which prevent reverse flow from the pressure chamber 58 to the common flow channel 52. Furthermore, the nozzles 64 are respectively connected to the pressure chambers 58 via nozzle flow channels 62.

A piezoelectric element 68 is provided on top of the diaphragm 66 which constitutes a wall of each of the pressure chambers 58. When a drive voltage is applied to the piezoelectric element 68, the volume of the pressure chamber 58 changes in accordance with the deformation of the diaphragm 66. When the diaphragm 66 deforms in the direction which increases the volume of the pressure chamber 58, then the meniscus formed in the nozzle 64 is pulled in toward the ink inflow side (the side of the pressure chamber 58), and the ink in the common flow channel 52 is sucked into the pressure chambers 58 via the individual supply channels 60, thereby performing refilling. On the other hand, when the diaphragm 66 is deformed in the direction which reduces the volume of the pressure chamber 58, the meniscus of the nozzle 64 is pushed out toward the ink ejection side (the opposite side to the pressure chamber 58), and an ink droplet is ejected from the nozzle 64. In particular, it is desirable that the interval between the pulling and pushing actions should be ¼ of the fluid resonance period of the pressure chamber 58 and the ink, whereby the pulling and pushing vibrations become mutually superimposed, a large displacement is obtained, and ejection of ink can be achieved readily.

When ink is being ejected, the ink inside the pressure chamber 58 not only flows through the nozzle flow channel 62, which is arranged on the ink ejection side, but also, a portion of the ink flows through the individual supply channel 60, which is arranged on the ink supply side. The ink flow volume from the pressure chamber 58 toward the nozzle flow channel 62 and the ink flow volume toward the individual supply channel 60 are determined by the ratios between the resistances and the inertances of the respective flow channels. In a typical inkjet head, the dimensions of the respective sections are determined in such a manner that the ratios are substantially 1 to 1.

Furthermore, as shown in FIG. 4, the common circulation channel 70 is provided in the recording head 50 according to the present embodiment. The nozzle flow channels 62 for a plurality of liquid droplet ejection elements 80 are connected to the common circulation is channel 70, via individual circulation channels 72. The common circulation channel 70 and the individual circulation channels 72 are circulation flow channels for circulating the ink which has been supplied from the common flow channel 52 to the pressure chambers 58. As shown in the depicted example, it is desirable that the individual circulation channel 72 should be connected to the nozzle flow channels 62 in the vicinity of the nozzles, whereby ink of increased viscosity in the vicinity of the nozzles can be circulated efficiently.

Figure 5:
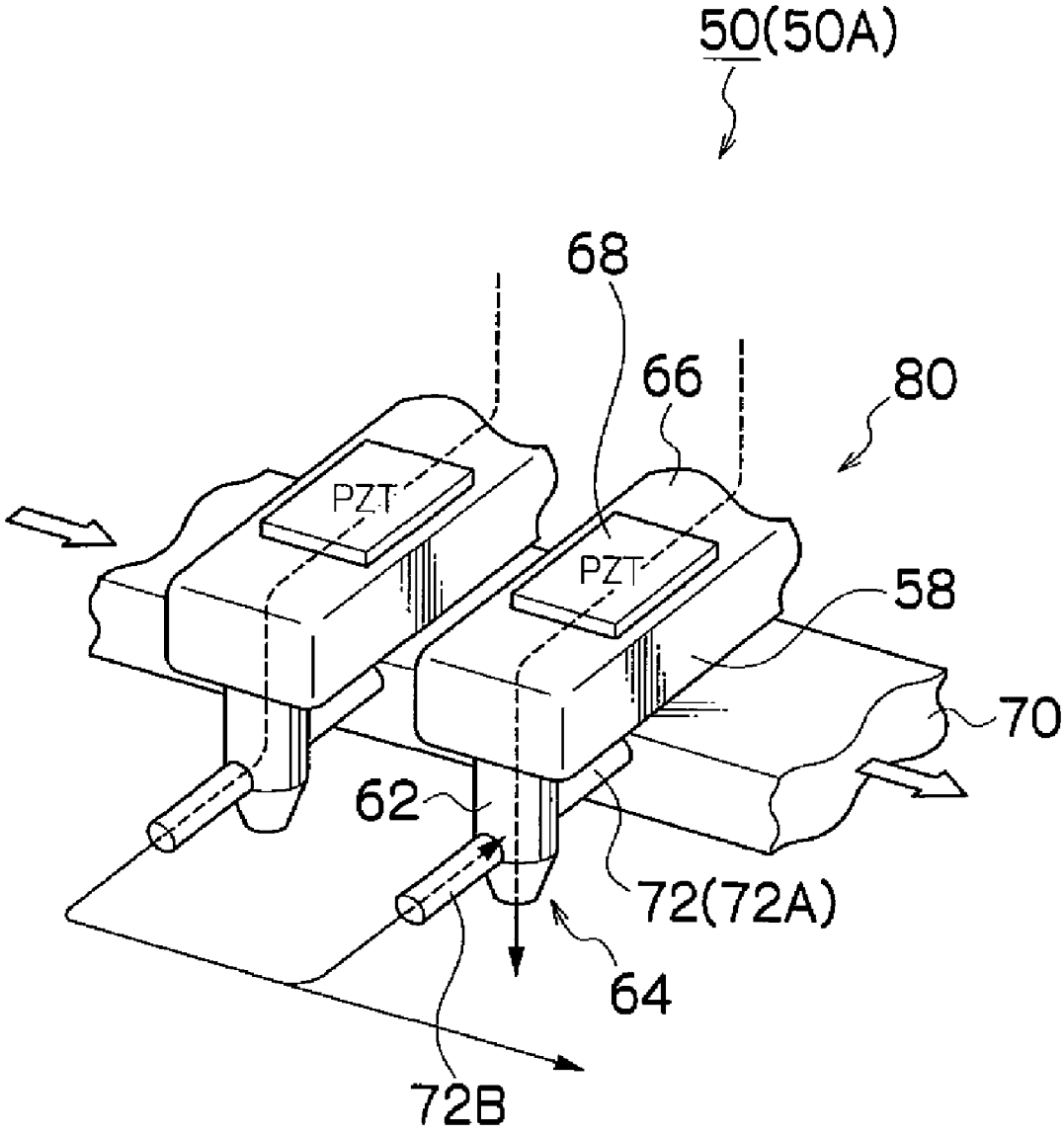
FIG. 5 is a perspective diagram showing a three-dimensional view of the periphery of the pressure chambers of a recording head.

FIG. 5 is a schematic drawing showing a three-dimensional view of the periphery of the pressure chambers 58 of the recording head 50. As shown in FIG. 5, two individual circulation channels 72 (72A, 72B) are connected to one nozzle flow channel 62. The individual circulation channels 72A and 72B are respectively connected to two different common circulation channels 70. In FIG. 5, the common circulation channel which is connected to the individual circulation channel 72B is not depicted, and furthermore, in FIG. 3 and FIG. 4, for the sake of convenience, only one individual circulation channel 72 connected to the nozzle flow channel 62 is depicted. In implementing the present invention, at least one individual circulation channel 72 is connected to each of the nozzle flow channels 62. Furthermore, there is also a mode in which the individual circulation channel 72 is connected directly to the pressure chamber 58, as described hereinafter.

Figure 6:
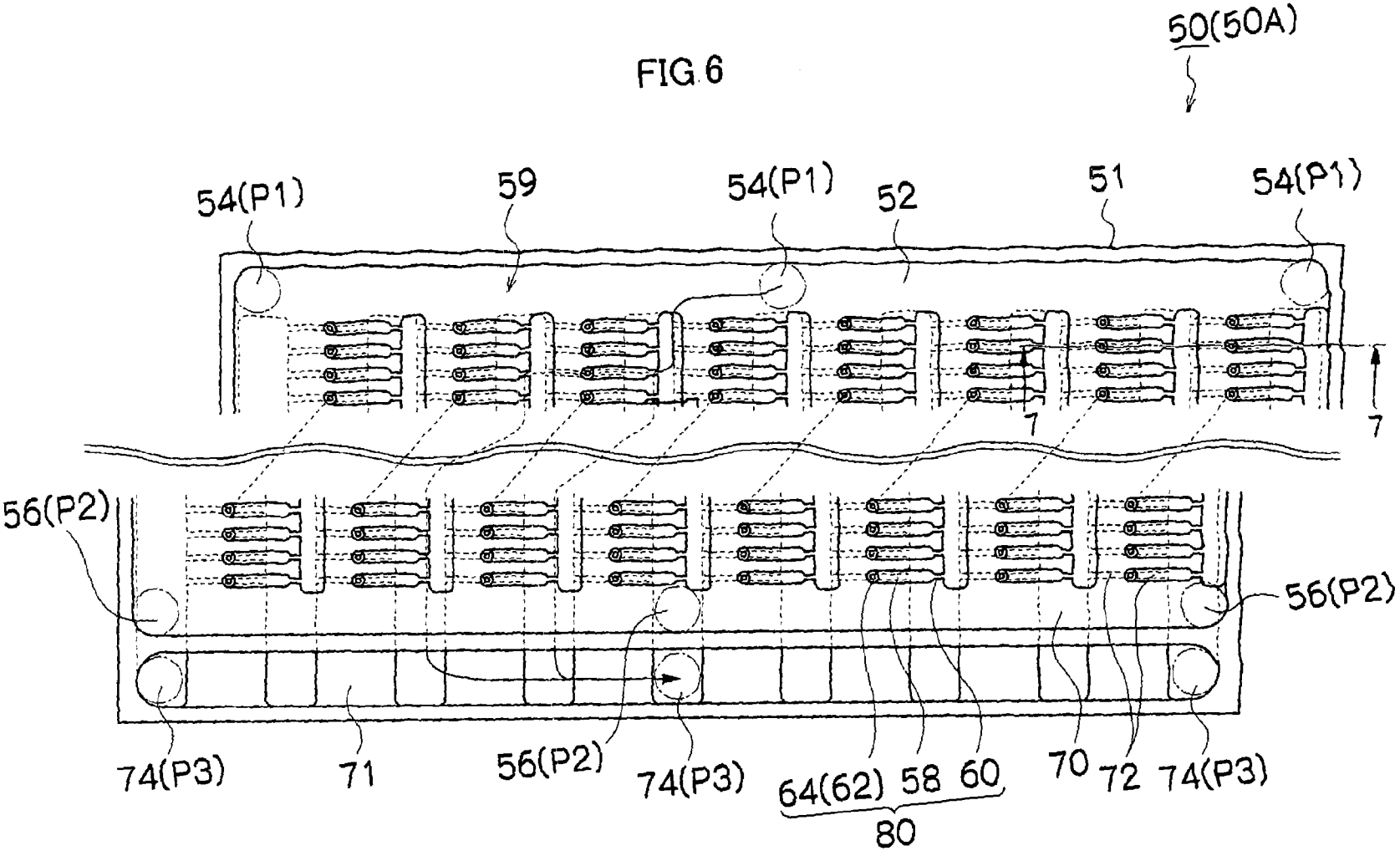
FIG. 6 is a plan diagram showing the detailed structure of a recording head.
Figure 7:
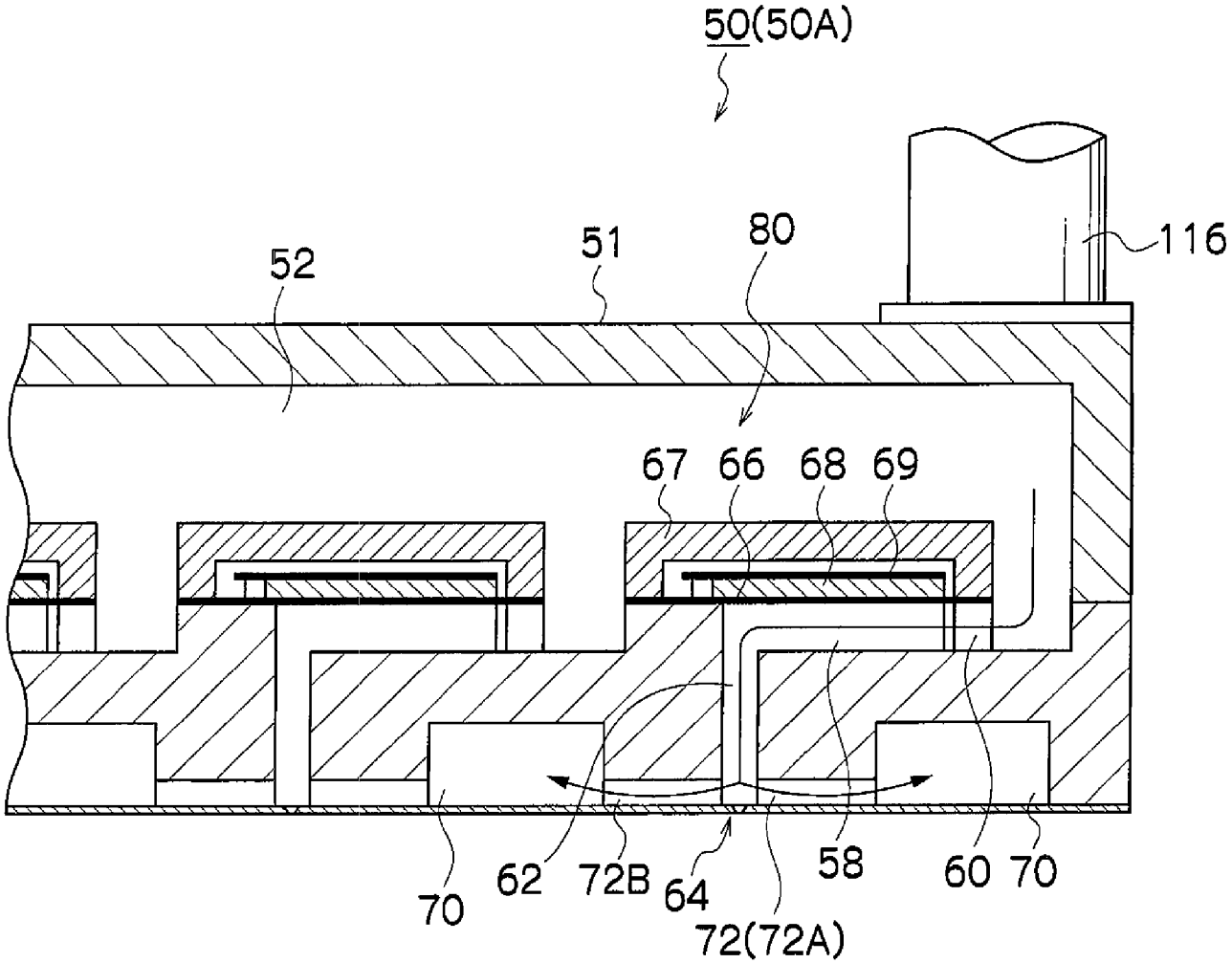
FIG. 7 is a cross-sectional diagram along line 7-7 in FIG. 6.

FIG. 6 is a plan diagram showing the detailed structure of the recording head 50. FIG. 7 is a cross-sectional diagram showing one portion of a recording head 50 (a cross-sectional diagram along line 7-7 in FIG. 6). In FIG. 6, in order to aid understanding of the arrangement and composition of the pressure chambers 58, the diaphragm 66 and the piezoelectric elements 68 are not depicted. The recording head 50 according to the present embodiment is constituted by arranging a plurality of head units 51 such as that shown in FIG. 6 and FIG. 7. Of course, it is also possible to compose a head by means of one head unit 51 only.

As shown in FIG. 6, liquid droplet ejection elements 80 each comprising a nozzle 64 and a pressure chamber 58 are arranged in a matrix configuration (two-dimensional configuration) in the head units 51. The common flow channel 52 is formed so as to cover the whole of the region in which the pressure chambers 58 are formed, and three first supply ports 54 and three second supply ports 56 are provided respectively so as to open to the common flow channel 52.

Furthermore, a plurality of common circulation channels 70 are provided in the head unit 51, each of the common circulation channels 70 corresponding to each column 59 of pressure chambers. Each of the common circulation channels 70 is connected to the pressure chambers 58 which belong to the corresponding one of the pressure chamber columns 59. More specifically, as shown in FIG. 7, the pressure chambers 58 are connected to the common circulation channel 70 through the nozzle flow channels 62 and the individual circulation channels 72, respectively. The plurality of common circulation channels 70 are joined into one channel by means of a connecting flow channel 71, and three collection ports 74 are formed in the connecting flow channel 71.

As shown in FIG. 7, piezoelectric elements 68 provided with individual electrodes 69 are provided on top of the diaphragm 66 which constitutes the wall surface of the pressure chamber 58. For the diaphragm 66, it is possible to use a conductive substrate which includes an electrode layer (conductive layer) at least on the surface thereof. In this case, the diaphragm 66 also serves as a common electrode for the piezoelectric elements 68. A piezoelectric body, such as lead titanate zirconate (piezo material), is used for the piezoelectric element 68. Furthermore, a protective cover 67 is provided so as to cover each piezoelectric element 68 on the diaphragm 66, thereby achieving insulation and protection of the piezoelectric element 68 and the other wiring members (not illustrated) from the ink inside the common flow channel 52.

In the recording head 50 having the above-described composition, as shown in FIG. 4, taking the pressure of the ink in the first supply port 54 formed to the upstream side of the common flow channel 52 to be P1, taking the pressure of the ink in the second supply port 56 formed to the downstream side of the common flow channel 52 to be P2, and taking the pressure of the ink in the collection port 74 formed at one end of the common circulation channel 70 (and more specifically, in the connecting flow channel 71) to be P3, then if the respective pressures P1, P2 and P3 are set or controlled so that they have a relationship of P1>P2>P3, then a flow of ink is created from the upstream side to the downstream side of the common flow channel 52, and furthermore a flow of ink is created from the common flow channel 52 to the common circulation channel 70, via the individual supply channels 60, the pressure chambers 58, the nozzle flow channels 62 and the individual circulation channels 72. In general, the cross-sectional area of the flow channel of the common flow channel 52 is large and the fluid resistance thereof is low, and therefore the pressure differential $\Delta P$ between the first supply port 54 and the second supply port 56 is approximately several hundred Pa through several kPa.

The temperature distribution of the interior of the recording head 50 (and in particular, the temperature distribution of the ink) becomes uniform due to the flow of ink created in the common flow channel 52, and furthermore, even if air bubbles become mixed into the common flow channel 52, it is possible to remove these air bubbles swiftly from the second supply port 56 on the low pressure side. Moreover, due to the flow of ink created in the direction from the common flow channel 52 toward the common circulation channel 70, via the pressure chambers 58 and the like, it is possible to circulate the ink of raised viscosity in the vicinity of the nozzles, and it is possible to prevent ejection defects. The control of the circulation of ink, which is one of the characteristic features of the present invention, will be described later.

The flow volume per unit time of the ink which flows in the common flow channel 52 can be determined from the pressure differential (P1-P2) in the ink between the first supply port 54 and the second supply port 56, and the fluid resistance of the common flow channel 52. It is preferable that the flow volume in the common flow channel 52 be an amount such that the temperature change due to the heat generated by the recording head 50 can be controlled, and it is preferable that the flow volume in the common flow channel 52 be set so as to cause a flowing movement of any air bubbles that may have entered into the common flow channel 52. These two requirements can be met when the flow volume in the common flow channel 52 is adequately large. At the same time, it is also necessary to set the flow volume to a range which does not create turbulence in the common flow channel 52. This is not likely to present an irreconcilable situation, given the amount of heat generated in a typical inkjet head, and the dimensions of a typical inkjet head.

For example, a practicable flow speed is some 10 to 20 times the amount of ink consumed per unit time in a state of full ejection from the head (namely, ejection in a case where ejection for printing is continued at maximum frequency and at maximum ejection volume). If a head which is ejecting 2 (pl) at 40 (kHz) has a nozzle density of 1200 (dpi), and a length of 2 inches per one head unit, then the ink consumption will be 2×2×1200×40000 (pl/sec)=0.192 (ml/sec), and therefore the ink volume flowing in the common flow channel 52 is set to approximately 2 to 4 (ml/sec).

The pressures P1 and P2 applied to the respective supply ports 54 and 56 by the pumps 120 and 124 are weak negative pressures, in such a manner that the meniscus formed at the opening sections of the nozzles 64 of the recording head 50 is slightly pulled in, and these pressures are set to −20 through −60 ($mmH_2O$) with respect to the atmospheric pressure.

In an inkjet head, the ink in the nozzle sections is typically set to a slightly negative pressure with respect to the atmospheric pressure, in order that the ink does not flow out from the nozzles which are not performing ejection. If this negative pressure is too strong, then the surface tension of the meniscus is overcome by the negative pressure and air is sucked in through the nozzles. For example, if using an ink having a surface tension of 35 mN/m for nozzles having a diameter of 18 μm, the maximum value of the surface tension will be $1.98\times10^{-6}$ (N), and therefore the surface tension per unit surface area of the nozzles will be 8 ($kN/m^2$). This value corresponds to 81 ($gf/cm^2$) through unit conversion, and therefore the meniscus is balanced when the negative pressure is at −810 ($mmH_2O$), and the meniscus breaks down if the negative pressure exceeds this value. However, in an actual bead, since there are a large number of nozzles, then there are many cases where the meniscus breaks down at a back pressure which is lower than this calculated value, due to factors such as the manufacturing precision and surface roughness of the nozzle sections, defects in the hydrophobic treatment on the nozzle sections, the occurrence of vibrations, or the like. Although it was difficult to obtain stable results through actual experiments due to the causes of instability described above, it has been found that the meniscus broke down at −100 through −400 ($mmH_2O$) in many cases. From this experimental result, a margin is allowed and the upper limit of the back pressure is set to −60 ($mmH_2O$) in the present embodiment. On the other hand, the lower limit is set to −20 ($mmH_2O$), in such a manner that ink does not leak out despite the application of a back pressure, due to the effects of vibrations, or environmental changes in the air pressure, temperature or the like. Neither of these values is determined logically, but rather they indicate a range in which stable performance can be achieved on the basis of experimental results.

Returning to FIG. 3, the flow channel 130 is connected to the collection ports 74 of the recording head 50. The pump 132 is provided in this flow channel 130, and a reserve tank 134 is connected to the end of the flow channel 130 opposite to the collection port 74. Ink which has been circulated from the common flow channel 52 through the individual supply channels 60, pressure chambers 58, nozzle flow channels 62, individual circulation channels 72, and common circulation channels 70, is collected from the collection ports 74 via the flow channel 130 and into the reserve tank 134, by the action of the pump 132.

In the flow channel 136 which connects the reserve tank 134 with the sub tank 102, a solvent concentration detector 104, a solvent addition apparatus 106, a deaeration apparatus 108, a pump 138 and a filter 140 are provided, in this sequence, from the upstream side (the side of the reserve tank 134) toward the downstream side (the side of the sub tank 102).

When the ink collected into the reserve tank 134 is returned to the sub tank 102 via the flow channel 136, firstly, the concentration of ink solvent is determined by the solvent concentration detector 104, on the basis of the ink density, viscosity, flow speed variation, electrical conductivity, or other properties. Thereupon, solvent from a solvent tank 144 is added to the ink in the flow channel 136 by the solvent addition apparatus 106, in accordance with the determination results obtained by the solvent concentration detector 104. By this means, it is possible to restore the ink which has been circulated via the pressure chambers 58 and the nozzle flow channels 62, and in particular, the ink which has increased in viscosity in the vicinity of the nozzles, to a suitable viscosity. As described hereinafter, the solvent concentration determined by the solvent concentration detector 104 is sent to a solvent concentration control unit 196 (see FIG. 8), and the solvent addition apparatus 106 is driven accordingly by this solvent concentration control unit 196.

Moreover, a process (deaeration process) is also carried out in order to reduce the amount of dissolved air in the ink, by means of the deaeration apparatus 108, which is connected to a vacuum pump 146. If a vacuum deaeration apparatus is provided on the upstream side (the side toward the recording head 50) from the pump 124 in the second flow channel 118 which connects the sub tank 102 with the recording head 50, then this deaeration apparatus 108 may be omitted.

The ink which has been deaerated by the deaeration apparatus 108 is then returned to the sub tank 102 through a filter 140, by means of the pump 138. Thereupon, the ink is supplied again to the recording head 50, together with ink supplied from the ink tank 100.

According to the composition of the ink circulation system shown in FIG. 3, since the reserve tank 134 is disposed between the pump 132 and the solvent addition apparatus 106 or the deaeration apparatus 108, then it is possible to prevent any of the recycling processes, such as addition of solvent or deaeration, from affecting the pressure P3 which is to be applied to the collection ports 74 by the pump 132.

In general, heat is generated in the recording head 50 due to the operation of the actuators (piezoelectric elements 68), and therefore the ink which is circulated as described above also serves to remove the heat thus generated in the recording head 50. Therefore, it is desirable that the temperature of the circulated ink should be adjusted when it is being recycled or when it is being supplied again.

Compositional of the Control System

Next, the control system of the inkjet recording apparatus 10 will be described.

Figure 8:
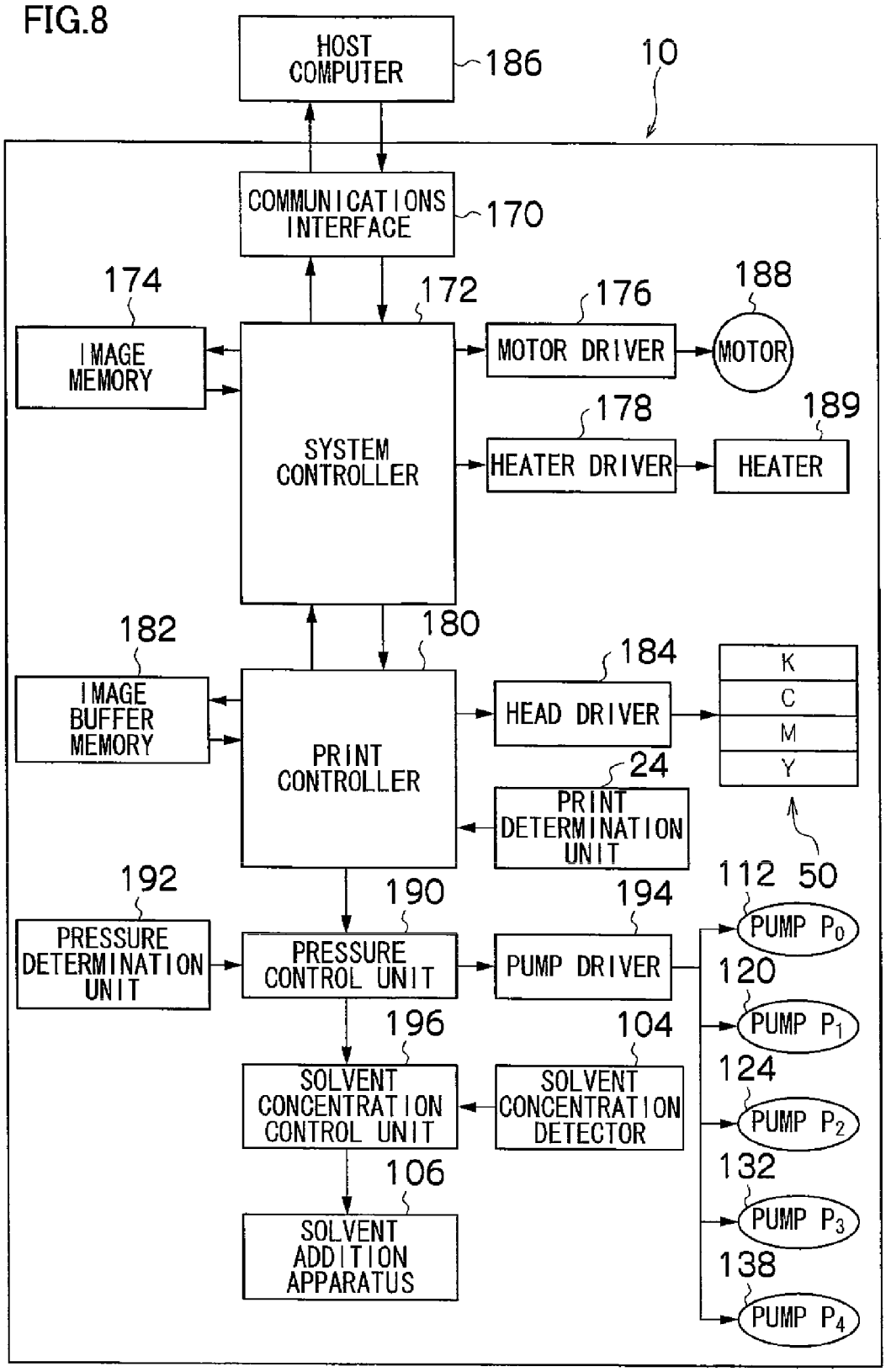
FIG. 8 is a principal block diagram showing the system composition of the inkjet recording apparatus.

FIG. 8 is a principal block diagram showing the system configuration of the inkjet recording apparatus 10. The inkjet recording apparatus 10 comprises a communication interface 170, a system controller 172, an image memory 174, a motor driver 176, a heater driver 178, a print controller 180, an image buffer memory 182, a head driver 184, and the like.

The communication interface 170 is an interface unit for receiving image data sent from a host computer 186. A serial interface or a parallel interface may be used as the communication interface 170. A buffer memory (not shown) may be mounted in this portion in order to increase the communication speed.

The image data sent from the host computer 186 is received by the inkjet recording apparatus 10 through the communication interface 170, and is temporarily stored in the image memory 174. The image memory 174 is a storage device for temporarily storing images inputted through the communication interface 170, and data is written and read to and from the image memory 174 through the system controller 172. The image memory 174 is not limited to a memory composed of semiconductor elements, and a hard disk drive or another magnetic medium may be used.

The system controller 172 is a control unit which controls the respective sections, such as the communications interface 170, the image memory 174, the motor driver 176, the heater driver 178, and the like. The system controller 172 is made up of a central processing unit (CPU) and peripheral circuits thereof, and as well as controlling communications with the host computer 186 and controlling reading from and writing to the image memory 174, and the like, it generates control signals for controlling the motors 188 and heaters 189 in the conveyance system.

The motor driver (drive circuit) 176 drives the motor 188 in accordance with commands from the system controller 172. The heater driver (drive circuit) 178 drives the heater 189 of the post-drying unit 42 or other units in accordance with commands from the system controller 172.

The print controller 180 has a signal processing function for performing various tasks, compensations, and other types of processing for generating print control signals from the image data stored in the image memory 174 in accordance with commands from the system controller 172 so as to supply the generated print control signal (dot data) to the head driver 184. Prescribed signal processing is carried out in the print controller 180, and the ejection amount and the ejection timing of the ink droplets from the respective recording heads 50 are controlled via the head driver 184, on the basis of the print data. By this means, prescribed dot size and dot positions can be achieved.

The print controller 180 is provided with the image buffer memory 182; and image data, parameters, and other data are temporarily stored in the image buffer memory 182 when image data is processed in the print controller 180. The aspect shown in FIG. 8 is one in which the image buffer memory 182 accompanies the print controller 180; however, the image memory 174 may also serve as the image buffer memory 182. Also possible is an aspect in which the print controller 180 and the system controller 172 are integrated to form a single processor.

The head driver 184 generates drive signals for driving the piezoelectric elements 68 (see FIG. 4 or the like) of the recording heads 50 of the respective colors, on the basis of the print data supplied from the print controller 180, and supplies the generated drive signals to the piezoelectric elements 68. The head driver 184 can be provided with a feedback control system for maintaining constant drive conditions for the recording heads 50.

The print determination unit 24 is a block that includes the line sensor as described above with reference to FIG. 1, reads the image printed on the recording paper 16, determines the print conditions (presence of the ejection, variation in the dot formation, and the like) by performing desired signal processing, or the like, and provides the determination results of the print conditions to the print controller 180.

According to requirements, the print controller 180 makes various corrections with respect to the recording head 50 on the basis of information obtained from the print determination unit 24.

Moreover, the inkjet recording apparatus 10 according to the present embodiment comprises a pressure control unit 190, a pressure determination unit 192, a pump driver 194, a solvent concentration control unit 196, and the like.

The pressure determination unit 192 determines the pressure in the common flow channel of the recording head 50 (at the position where the supply port is formed), and the pressure in the common circulation flow channels (at the position where the collection port is formed), and it supplies pressure signals including these determination results to the pressure control unit 190.

The pressure control unit 190 receives information indicating the number of dots to be printed, from the print control unit 180, and calculates the total ink ejection volume for the recording head 50 (or for the head unit 51), and furthermore, it also supplies pump drive control signals to the pump driver 194 on the basis of the pressures determined by the pressure determination unit 192, in such a manner that a desired ink circulation volume is achieved by adjusting the ink supply volume in accordance with the calculated ink ejection volume. The pump driver 194 drives the respective pumps 112, 120, 124, 132 and 138 on the basis of the pump drive control signals supplied from the pressure control unit 190.

Furthermore, the pressure control unit 190 sends instructions regarding a solvent concentration value to the solvent concentration control unit 196, in accordance with the ink circulation volume. The solvent concentration control unit 196 drives the solvent addition apparatus 106 on the basis of the solvent concentration value determined by the solvent concentration detector 104, in such a manner that the solvent concentration instructed by the pressure control unit 190 is achieved. Accordingly, a suitable volume of solvent is added to the ink which has been collected and circulated.

Control of Ink Circulation

Firstly, the relationship between the ink volume required to prevent ejection defects and the ejection volume used by printing will be described.

<The Minimum Ejection Volume Required to Prevent Ejection Defects>

With regard to the phenomenon of evaporation of solvent from the nozzles which causes increase in the viscosity of the ink and leads to ejection defects, provided that a nozzle always performs ejection at or above a certain frequency, then this is equivalent to continuously doing away with the ink which has increased in viscosity due to evaporation of the solvent, and therefore ejection defects can be prevented by means of continuous ejection of that frequency.

The threshold frequency of "at or above a certain frequency" depends on various conditions, such as the ambient temperature and humidity conditions, the state of air flow in the periphery of the head, the solvent component of the ink, and the volumes of the respective components of the ink, and the like. Through experimentation carried out by the present inventors, it was found that if ink droplets of 4 pl are ejected in one ejection action, using an ink containing a solvent of water, under normal temperature and normal humidity conditions, then the frequency of ejection must be once or more every 0.1 seconds approximately.

At first sight, this appears to be a relatively low frequency, and it can be imagined that no particular problems would be created in the printed object if ink were to be ejected at a frequency satisfying this condition during printing, regardless of the image being printed. However, this ejection frequency is in fact highly likely to give rise to problems in the printed object, unless the image is one that is printed by ejecting at a substantially uniform rate from all of the nozzles, or unless the printing speed is extremely fast and the volume of ink discarded in this manner during the printing of one sheet is extremely small. For example, if printing is carried out on one sheet of A4 paper in 0.5 seconds from a fixed head, then the aforementioned condition implies ejecting five times from all of the nozzles during the printing of one sheet. Since ejection of this kind is necessary particularly for blank areas where ejection is not performed from the nozzles for a prescribed period of time and where there are few dots, then the density at the originally white blank surface will inevitably be raised, even if the five ejections are performed from each of the nozzles so as to create the largest possible gaps between the dots.

Here, although the term "white blank surface" is used, for each of the inks of respective colors used in this inkjet recording apparatus, the region where no ink of that color is printed is considered as a "white blank surface" for that color, In other words, in a case where the whole areas of the printed object are covered with inks, although it may be regarded that there is no blank surface, since the problem discussed here must be considered in terms of each color of the inks, then the blank surface is in fact liable to exist in respect of any of the colors.

Conversely, under conditions where there is no blank surface in respect of any of the colors, then this means that each of the colored inks is being ejected at a certain frequency, and therefore in the whole printed object (and not just locally) there is a presence of gray to black colored regions. This also includes objects which are printed by spacing out the inks of the respective colors to create the greatest possible intervals between dots in order that the inks are not mutually superimposed, and in printed objects of this kind, the overall appearance to a visual observer is a gray color. Needless to say, the aforementioned ejection frequency condition can also be satisfied by ejecting the inks of the respective colors locally, in an independent fashion, but in this case the resulting printed object will obviously differ from the originally intended image. Moreover, in a low-humidity environment, the stated frequency of "once every 0.1 seconds" is increased, and therefore the density of the blank surface is raised even further.

In other words, it depends on the image being printed whether or not beneficial effects can be obtained in respect of discarding ink which has risen in viscosity, by means of the method described here. Moreover, the greater the amount of blank surface in the printed object and therefore the greater the need to discard ink, the more conspicuous the discarded ink becomes and the harder it becomes to discard the ink. Therefore, practical implementation of this method becomes more difficult.

Consequently, the method of discarding ink which has increased in viscosity, by ejection in portions other than the original image, is limited in terms of the conditions under which it can be implemented, and therefore it is impracticable.

<Average Ejection Volume in Printing>

However, when viewed in terms of the whole print medium, provided that the image is not a completely blank sheet, then ejection of some volume of ink can be expected per unit surface area, as described below. For example, in a printed object which has a high ejection volume, including a photograph, or the like, the average ink ejection volume per unit surface area is approximately 1 cc/$M^2$, and this is equivalent to a print rate of approximately 22% (the surface area covered with ink when recording with an ink droplet size of 2 pl at a resolution of 1200 dpi). Furthermore, even with an A4-sized printed object bearing black text characters and having a print rate of 5%, which is specified as a standard sheet, if the print medium is conveyed in the breadthways direction with respect to a fixed inkjet head having a printing width of 297 mm, and if recording is carried out using an ink droplet size of 2 pl at a resolution of 1200 dpi, then the average ejection volume per nozzle will be 992 pl. Supposing conditions where one sheet of A4-size medium is printed in 0.5 seconds, as described previously, this means that 198 ejections are performed every 0.1 seconds, and hence this ejection frequency is considerably higher than the condition of ejection "at or above a frequency of once every 0.1 seconds approximately" as stated above.

However, even in the case of ejection at a high average frequency in this way, as mentioned previously, it depends on the print image which of the nozzles eject ink, and hence there may be a print image in which particular nozzles do not perform printing at all. Moreover, if the same content is printed on a plurality of sheets, then the particular nozzles continue in a state of not performing printing at all, for a long period of time.

Consequently, although ink may be ejected at a level which would avoid problems in the case of normal printing, if the average value for the whole head is considered, since there are in fact variations in the ejection volumes of nozzles, then there is no guarantee that the conditions for avoiding problems are satisfied at all times. Furthermore, as stated above, there are also problems with the implementation of a method which performs the minimum necessary ejection to prevent ejection defects, by distributing ejection throughout the image. Consequently, various countermeasures such as those described in the related art are necessary.

However, provided that good and effective use is made of the circumstances described above in which a sufficient volume of ink is ejected in average terms, then it is possible significantly to improve the problem of ejection defects.

Focusing on this point, the present invention circulates the ink of increased viscosity in the vicinity of the nozzles through the common circulation channels in cases where the overall ink ejection volume is low. Moreover, in cases where the overall ink ejection volume is high, the ink supply volume is set to be equal to the ink ejection and the degraded ink which has been circulated through the common circulation channels is returned to the ejecting nozzle side and is ejected from the ejecting nozzles together with fresh ink supplied from the common flow channel side. The control of ink circulation according to the present invention is described more specifically below.

In normal meniscus shaking, in order to prevent increase in the viscosity of the ink in the vicinity of the nozzles due to evaporation of the solvent from the nozzles, the meniscus is shaken at a relatively large amplitude of a level which does not cause the ink to be ejected from the nozzles, and the ink in the vicinity of the nozzles is thereby mixed and exchanged with the ink inside the pressure chambers. By this means, the ink viscosity in the nozzle sections is prevented from increasing for a certain time.

However, since the volume of the pressure chambers is limited, then if meniscus shaking is continued, the ink viscosity in the whole of the pressure chamber eventually rises and ejection defects inevitably occur.

In response to this, in the present embodiment, the ink circulation side (the common circulation channel 70 side) is set to a relative negative pressure with respect to the ink supply side (the common flow channel 52 side), and a sufficiently low flow speed compared to the average flow speed of the ink supply accompanying the ink ejection, in other words, a slow circulation flow, is created. In this case, the meniscus is shaken at a low frequency which is ½ to 1/100 (and more desirably, 1/20 to 1/100) the frequency of normal meniscus shaking, in such a manner that ink which has started to rise in viscosity is caused to move to the vicinity of the opening section of the individual circulation channel 72 (the opening in the nozzle flow channel 62, or the junction port). Due to this meniscus shaking at a low frequency of ½ to 1/100, the ink which has started to increase in viscosity in the vicinity of the nozzles is mixed together with the ink in the vicinity of the opening section of the individual circulation channel 72, and this ink is drawn into the individual circulation channel 72 together with the ink which flows in from the pressure chamber 58 due to the ink circulation flow.

Meniscus shaking is carried out at a low frequency of ½ to 1/100 compared to normal meniscus shaking in this way in order to minimize the change in the viscosity of the ink inside the pressure chambers 58.

In a state of this kind, the solvent concentration acquires a gradient, whereby the solvent concentration becomes lower on the nozzle 64 side compared to the individual circulation channel 72 side, from the surface section (opening section) of the nozzle 64 toward the vicinity of the opening section of the individual circulation channel 72. In other words, the vicinity of the opening section of the individual circulation channel 72 assumes a state of substantially fresh ink due to the circulation of ink.

In the state described above, the ink can be ejected from the nozzles 64. The ink at the surface section (opening section) of the nozzle 64 has relatively high viscosity, and therefore the speed of diffusion of solvent in the ink is slow, the replenishment of solvent to the surface section of the nozzles 64 is slow. Consequently, a state which suppresses the evaporation of solvent is achieved and the total volume of evaporated solvent can be reduced.

In the present embodiment, the ink of increased viscosity in nozzles 64 of a low ejection frequency flows from the individual circulation channel 72 to the common circulation channel 70 due to the slow circulation flow. The flow speed of the ink is adjusted whereby, although the ink of increased viscosity has higher viscosity than in the initial state, the ink does not increase in viscosity to the extent that the ink ejection is impossible. For example, the flow volume is 400 (pl/sec per nozzle), which is much smaller than the full ejection volume (the amount of ink ejected by continuous ejection for printing at maximum frequency and maximum ejection volume) and represents an extremely small amount compared to the ink circulation volume which is implemented generally in the related art.

Next, the ink circulation volume is described with reference to FIGS. 9 and 10.

Figure 9:
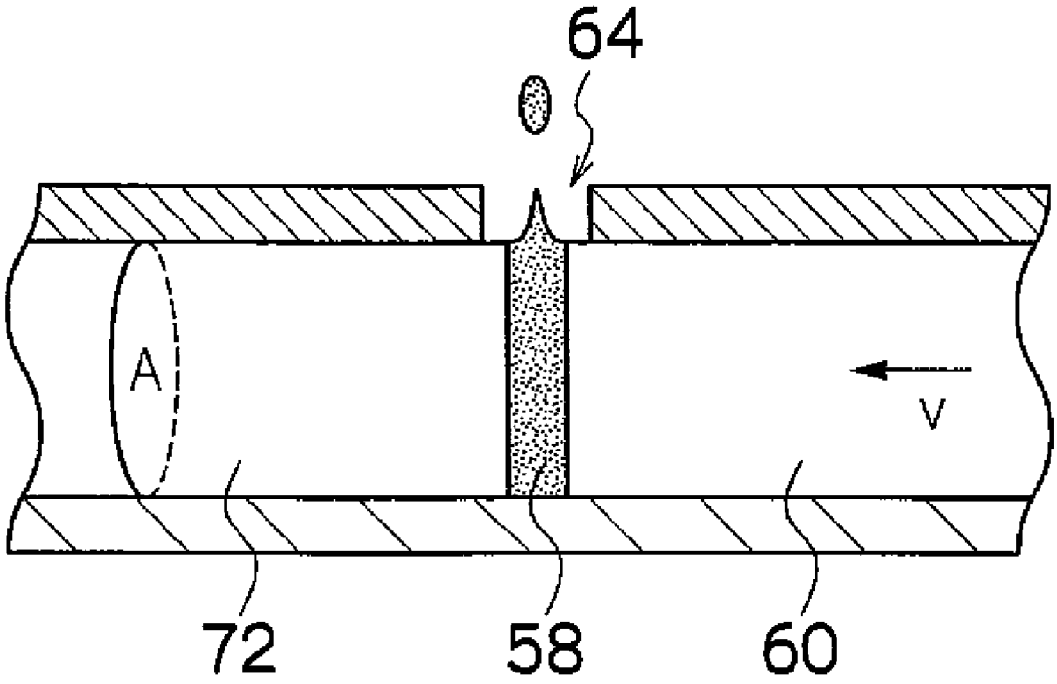
FIG. 9 is a model diagram showing an abstract view of a recording head.

FIG. 9 is a model drawing showing an abstract view of a recording head 50 according to the present embodiment, and for the sake of the description, the individual supply channel 60, the pressure chamber 58 and the individual circulation channel 72 are depicted as having the same cross-sectional area, and furthermore, the volume of the nozzle flow channel 62 is taken to be zero and the nozzle flow channel 62 is omitted from the drawings. In FIG. 9, taking the average flow speed of the ink supplied from the individual supply channel 60 to the pressure chamber 58 to be v, taking the cross-sectional area of each of the respective flow channels (the individual supply channel 60, the pressure chamber 58 and the individual circulation channel 72) to be A, and taking the volume of ink ejected from the nozzle 64 in the time period t to be V, then the ink supply volume per unit time (hereinafter, simply called "the ink supply volume") is A×v, and the ink ejection volume per unit time (hereinafter, simply called "the ink ejection volume") is V/t.

Figure 10:
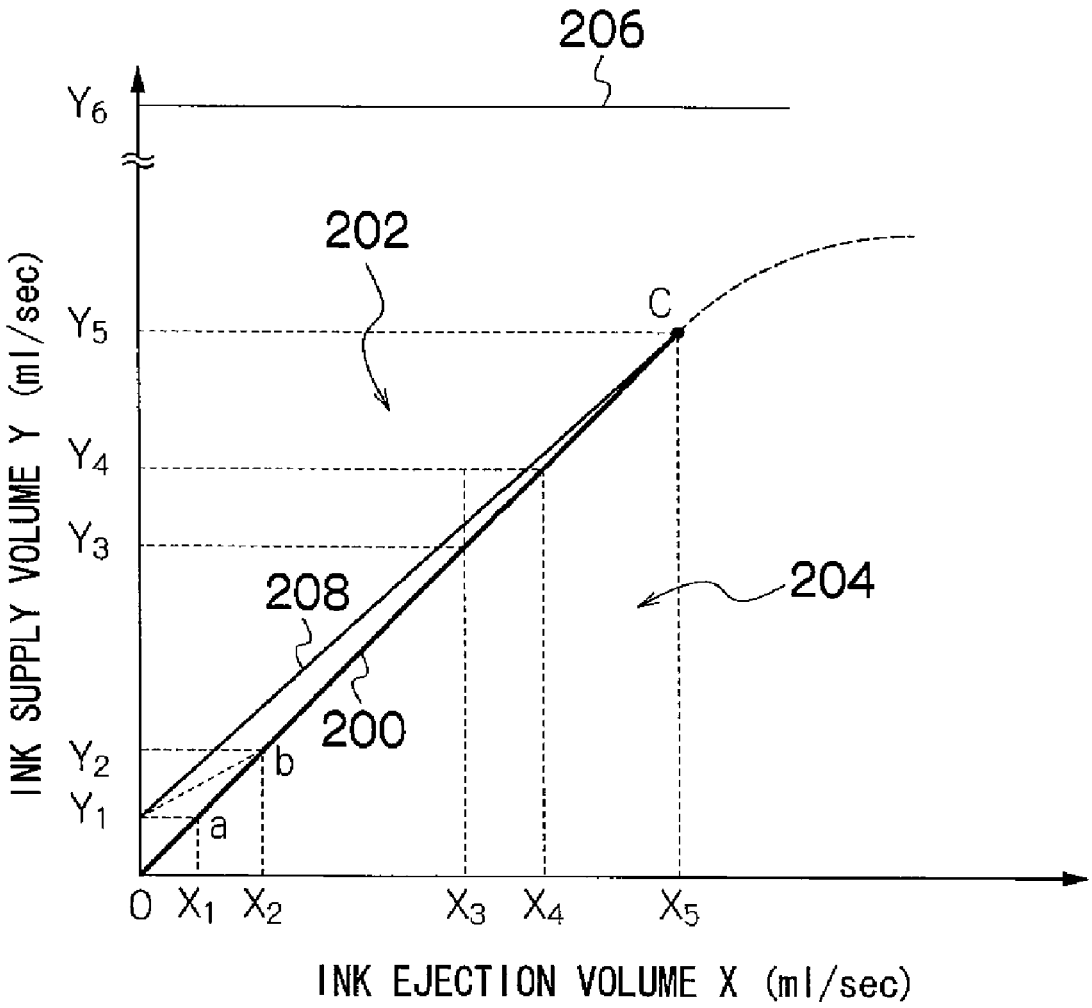
FIG. 10 is a diagram showing the relationship between the ink ejection volume and the ink supply volume.

FIG. 10 is a graph showing the relationship between the ink ejection volume and the ink supply volume. The horizontal axis of FIG. 10 represents the ink ejection volume ejected from one nozzle 64 shown in FIG. 9 (ink ejection volume per unit time) X (=V/t) (mi/sec), and the vertical axis of FIG. 10 represents the ink supply volume supplied to the pressure chamber 58 (the ink supply volume per unit time) Y (=A x v) (ml/sec). Furthermore, if the subscript of the ink ejection volume X and the subscript of the ink supply volume Y are the same, then this indicates that these volumes are equal. For example, ink ejection volume $X_1$ is equal to ink supply volume $Y_1$. Although FIG. 10 shows a relationship between the ink ejection volume and the ink supply volume in one nozzle 64, the relationship between the ink ejection volume and the ink supply volume in the whole of the recording head 50, in one or more head units 51, or in a plurality of pressure chambers 58, is similar to the relationship shown in FIG. 10, except that the absolute values are different.

In FIG. 10, a straight line (the straight line linking the point of origin with point c) 200 having a gradient of 45 degrees passing through the point of origin represents a case where the ink ejection volume X and the ink supply volume Y are equal. In other words, the upper region 202 which is above the straight line 200 relates to a case where the ink supply volume is higher than the ink ejection volume, and this is a region where ink circulation is carried out. The ink circulation volume is the difference between the ink supply volume and the ink ejection volume. On the other hand, the lower region 204 which is below the straight line 200 relates to a case where the ink supply volume is lower than the ink ejection volume, and this is a region where the ink supply does not keep up with the ink ejection and ink shortage occurs.

In a recording head which does not have an ink circulation function, the relationship between the ink ejection volume and the ink supply volume is indicated by the straight line 200 shown in FIG. 10. However, in an inkjet system, there are limitations on the speed of the ink supply, due to the fluid resistance, and if the ink ejection volume exceeds a certain prescribed volume, then the ink supply volume approaches to a constant value, and hence the ink supply volume cannot keep up with the ink ejection volume. Furthermore, in a recording head based on a piezoelectric method which uses piezoelectric elements made of piezo material, or the like, ink is ejected by utilizing the resonance of the pressure chamber, and therefore the resonance frequency may determine these limitations. In the graph shown in FIG. 10, since the point c which indicates the ink ejection volume $X_5$ at full ejection (ejection in a case where ejection for printing is continued at maximum frequency and maximum ejection volume) is in the vicinity of the point where the ink supply volume Y starts to fall short (i.e., the ink supply volume Y starts to converge to a constant value), then this means that these two limitations are substantially equal.

On the other hand, in a recording mode which has the ink circulation function used in the related art, the ink supply volume $Y_6$ may be sufficiently greater than the ink supply volume $Y_5$ (=$X_5$) at full ejection, regardless of the ink ejection volume X, in such a manner that there is no shortage of ink even when performing full ejection, as indicated by the straight line 206 which is parallel to the horizontal axis shown in FIG. 10, for example. However, in a case of this kind, there is a problem in that the ink circulation volume (=Y−X), which is the differential between the ink supply volume X and the ink ejection volume Y, becomes greater in the recording head as a whole.

Figure 11A:
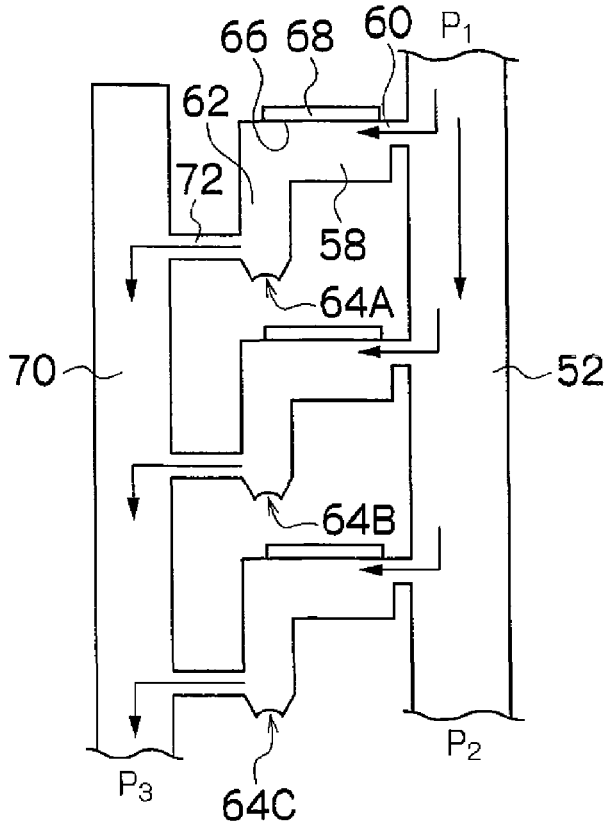
FIGS. 11A and 11B are illustrative diagrams showing the flow of ink.
Figure 11B:
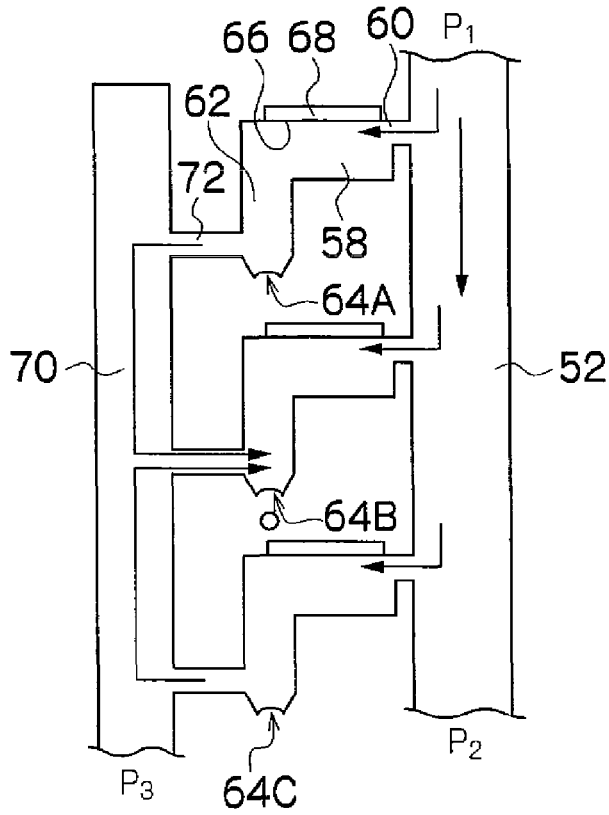

Therefore, in the present invention, if the ink ejection volume is less than the minimum ink ejection volume required to prevent ejection defects, then the ink supply volume is adjusted to be greater than the ink ejection volume. An ink flow is thereby created from each of the nozzles 64A, 64B and 64C toward the common circulation channel 70, and the degraded ink in the nozzles 64A, 64B and 64C is circulated into the common circulation channel 70, as shown in FIG. 11A. On the other hand, if the ink ejection volume is equal to or greater than the minimum ink ejection volume required to prevent ejection defects, then the ink supply volume is adjusted to be substantially equal to the ink ejection volume. Thereby, due to the ink supply operation performed before and after ejection from the ejecting nozzle 64B, which is the nozzle performing an ejection operation (as shown in FIG. 11B) of the plurality of nozzles 64A, 64B and 64C that are connected with each other via the common circulation channel 70, a flow of ink is created from the non-ejecting nozzles 64A and 64C, which are not performing an ejection operation, toward the ejecting nozzle 64B, via the common circulation channel 70. Moreover, the degraded ink in the vicinity of the non-ejecting nozzles 64A and 64C is circulated into the common circulation channel 70, and furthermore, the degraded ink circulated into the common circulation channel 70 is further circulated toward the ejecting nozzle 64B side, where it mixes with fresh ink supplied from the common flow channel 52 side and is ejected from the ejecting nozzle 64B.

More specifically, in FIG. 10, taking the minimum ink ejection volume required to prevent ejection defects to be $X_1$, then if the ink ejection volume is equal to or greater than zero and less than $X_1$ , a uniform ink supply volume $Y_1$ ($=X_1$) is adopted. On the other hand, if the ink ejection volume is equal to or greater than $X_1$, then a new ink supply volume Y (=X) which is equal to the ink ejection volume X is adopted. In other words, in FIG. 10, ink circulation control is implemented so that the relationship indicated by a line linking "$Y_1$" on the vertical axis, point "a" and point "c" can be satisfied.

The ink circulation control according to the present invention which was described above is based on ideal conditions. If the ink ejection volume X is $X_1$, which is the minimum ink ejection volume required to prevent ejection defects, then the ink supply volume $Y_1$ is set to be equal to the ink ejection volume $X_1$. Thus, there is no margin with respect to any slight variations, such as environmental changes, and there is a possibility that ejection defects, such as ink shortages, may occur.

In the recording head 50 according to the present embodiment, if the ink ejection volume is less than the ink ejection volume $X_2$ ($>X_1$), then the ink supply volume is made greater than the ink ejection volume, and the ink supply volume is gradually increased as the ink ejection volume increases. On the other hand, if the ink ejection volume is greater than the ink ejection volume $X_2$, then the ink supply volume is set to be equal to the ink ejection volume. If the ink ejection volume is equal to the ink ejection volume $X_2$, then either option is possible. In the present embodiment, for the sake of convenience, the ink supply volume is set to be equal to the ink ejection volume whenever the ink ejection volume is equal to or greater than $X_2$. In other words, in FIG. 10, ink circulation control is implemented in order to satisfy the relationship indicated by a line linking "$Y_1$" on the vertical axis, point "b" and point "c".

In implementing the present invention, the ink supply volume when the ink ejection volume is less than $X_2$ as described above may of course also be set to a uniform volume (in other words, a volume not less than $Y_2$), regardless of the ink ejection volume.

The ink flows into the liquid droplet ejection element 80 including the pressure chamber 58, and the like, from the common flow channel 52 and from the common circulation channel 70. The ratio between these ink flows is determined by the ratios of the flow resistance and the inertance between the individual supply channel 60 and the individual circulation channel 72, and the pressure differential between the common flow channel 52 and the common circulation channel 70. Therefore, in the present embodiment, taking the resistance of the individual supply channel 60 to be $R_s$, taking the inertance thereof to be $L_s$, taking the resistance of the nozzle flow channel 62 to be $R_n$, taking the inertance thereof to be $L_n$, taking the resistance of the individual circulation channel 72 to be $R_r$ and taking the inertance thereof to be $L_r$, (see FIG. 4), it is desirable that $R_s$, $R_n$, $R_r$, $L_s$, $L_n$ and $L_r$ have the following relationships.

$$R_s+R_r \approx R_n$$

$$L_s+L_r \approx L_n$$

$R_s >> R_r$ ($R_r$ is approximately 1/10 to 1/100 of $R_s$)

$L_s >> L_r$ ($L_r$ is approximately 1/10to 1/100 of $L_s$)

Furthermore, in FIG. 10, the ratio between the ink ejection volumes $X_1$ and $X_2$ is equal to the ratio between the resistance $R_r$ of the individual circulation channel 72 and the resistance $R_n$ of the nozzle flow channel 62. Namely, $X_1$, $X_2$, $R_r$ and $R_n$ have a relationship as follows:

$$X_1/X_2=R_r/R_n.$$

In other words, the volume of ink that is supplied from the individual circulation channel 72 to the nozzle flow channel 62 during ink ejection is determined by the ratio of the resistances between the individual circulation channel 72 and the nozzle flow channel 62. By this means, it is possible to reduce the effects caused by the individual circulation channel 72 during ink ejection.

For example, when a head having dimensions shown in Table 1, the relationship between $R_r$ and $R_n$ is as follows:

$$X_1/X_2=R_r/R_n=0.835/9.7=1/11.6.$$

Therefore, if $X_1$=400 (pl/sec), then $X_2$=4640 (pl/sec).

TABLE 1

| | DIAMETER (μm) | LENGTH (μm) | RESISTANCE (Pa · s/m$^3$) |
|---|---|---|---|
| Rr | 47 | 100 | $8.35 \times 10^{12}$ |
| Rn | 18 | 25 | $9.70 \times 10^{13}$ |
| Rs | 42 | 656 | $8.59 \times 10^{13}$ |

Moreover, the pressures P1, P2 and P3 (see FIG. 4) described above must be set to negative pressures, in order that the ink does not overflow from the nozzles 64. Supposing that the atmospheric pressure is 0 atm, then the pressures P1, P2 and P3 have a relationship as follows:

$$P3<-20 \text{ through } -60 \text{ (mmH}_2\text{O)}<P2<P1.$$

The relationship between the pressures P1 and P2 is determined by the resistance of the common flow channel 52 and the required flow speed.

Firstly, when not ejecting (when the ink ejection rate X =0), the pressure P3 is set in such a manner that the following conditions are satisfied:

$$-(P2-P3)/(R_s+R_r)=I,$$

where I is the minimum ink ejection volume required to prevent ejection defects and it corresponds to the ink ejection volume $X_1$ in FIG. 10. This ink ejection volume I ($=X_1$) depends on the characteristics of the ink, the structure of the head, the peripheral humidity and temperature environment of the head, and the flow of air, but in the case of a typical ink based on water solvent, the ink ejection volume I is approximately 400 (pl/sec) at minimum. Taking account of the manufacturing variations in the respective sections which make up the recording head 50, it is desirable that a margin of safety should be incorporated into the ink ejection volume I.

Furthermore, during ejection (when the ink ejection volume X>0), the pressures are set as follows. If the average ejection volume (which is represented as "Ia") is equal to or greater than the ink ejection volume $X_2$ (in other words, $Ia \geqq X_2$), then pressures are set so as to satisfy conditions of P2=P3. Furthermore, if the average ejection volume Ia is less than $X_2$ (in other words, if $0<Ia<X_2$), then pressures are set in such a manner that the following relationship is satisfied:

$$P3=(Ia/X_2)\,(P2-P3_n)+P3_n,$$

where $P3_n$ is the value of P3 during non-ejection.

The average ejection volume is calculated by dividing the total "Ia" of the ejection volume per unit time from all of the nozzles which are subject to control, by the total number of nozzles. For example, if there are 1000 nozzles and of these, 500 nozzles each perform continuous ejection of 2 (pl) of ink at 10 (kHz), then the average ejection volume can be calculated as follows:

$$Ia=500\times2\times10000/1000=10000 \text{ (pl/sec per nozzle).}$$

Furthermore, although the resistances $R_{cs}$ and $R_{cr}$ of the common flow channel 52 and the common circulation channel 70 are so small as to be ignorable, it is convenient to suppose a relationship of $R_{cs}\approx R_{cr}$, since this means that the pressure gradients in the common flow channel 52 and the common circulation channel 70 are the same, and therefore the ink circulation volume is virtually uniform in each of the pressure chambers 58.

By setting the respective parameters as described above, in FIG. 10, the ink ejection volume X and the ink supply volume Y have the relationship indicated by the line linking $Y_1$ on the vertical axis, with point b and point c.

According to the ink circulation control of this kind, if the ink ejection volume in the recording head 50 is less than the ink ejection volume $X_2$ which is obtained by incorporating a margin into the minimum required ink ejection volume $X_1$, then the ink supply volume is adjusted to be greater than the ink ejection volume (in other words, the ink circulation volume is increased), and hence it is possible to prevent ejection defects caused by increase in the viscosity of the ink in the vicinity of the nozzles. On the other band, if the ink ejection volume is equal to or greater than the ink ejection volume $X_2$, then by adjusting the ink supply volume to be equal to the ink ejection volume (in other words, by setting the ink circulation volume to zero), the degraded ink which has been circulated into the common circulation channel 70 is made to return toward the ejecting nozzles due to the ejection operation (and in particular the ink supply operation) at the ejecting nozzles, and this degraded ink can thereby be ejected from the ejecting nozzles together with fresh ink which has been supplied from the common flow channel 52. At the same time as this, since a flow of ink is created from the non-ejecting nozzles towards the common circulation channel 70, then it is also possible to prevent ejection defects in the non-ejecting nozzles.

By this means, it is possible to reduce the circulated ink volume (the volume of collected ink) which requires readjustment in respect of the solvent concentration and the amount of dissolved gas therein. Furthermore, if the printed object involves printing dots at or above a prescribed amount, then the volume of collected ink can be set to zero. Consequently, it is possible to reduce the costs of the consumables (including ink) and the devices which are required in order to achieve circulation of ink.

For instance, the following is an example of a calculation for determining the level of the ejection (printing) frequency at which the amount of the collected ink is zero. Firstly, the various conditions which are premises of this calculation are as follows.

Total number of nozzles: 1000
Ejection frequency: 40 (kHz)
Ejection volume: 2 (pl)
Circulation volume required at each nozzle: 400 (pl/sec per nozzle)

When the total circulation volume and the maximum ejection volume in one nozzle are calculated on the basis of these conditions, then the following values are obtained:

Total circulation volume: 400×1000=400000 (p/sec); and

Maximum ejection volume in one nozzle: $40\times10^3\times2=80000$ (pl).

Accordingly, (total circulation volume)/(maximum ejection volume in one nozzle) is calculated to be 5.

As a result of this, it is possible to eject the total volume of circulated ink for all of the nozzles by means of five nozzles performing ejection at the maximum rate. If an ejection volume ten times this amount is considered in order to allow some spare margin, then a total of 50/1000 (1/20=5% ) of the nozzles need to perform ejection at 40 kHz.

A normal printed object has at least a dot presence of approximately 5% on the medium surface. Consequently, there is a spare margin of exactly ten times.

In the present embodiment, as shown in FIG. 5, two individual circulation channels 72 (72A and 72B) are connected to each of the nozzle flow channels 62. It is also possible to connect three or more individual circulation channels 72 to each nozzle flow channel 62. According to a mode where one liquid droplet ejection element 80 is connected to a plurality of common circulation channels 70 in this way, it is possible to make the degraded ink which has been circulated into the common circulation channels 70 return more efficiently toward the ejecting nozzles, in the ink ejection control described above, and it is also possible further to reduce the volume of circulated ink which is either recycled or discarded.

In the present embodiment, as shown in FIG. 6, a plurality of common circulation channels 70 are provided in columns so as to correspond respectively to the pressure chamber columns 59 in each of the head units 51 which constitute the recording head 50, but the implementation of the present invention is not limited to this embodiment. For instance, it is also possible to form a common circulation channel which covers the whole of the region where the pressure chambers 58 are formed, similarly to the common flow channel 52, and it is also possible to form a lattice-shaped (mesh-shaped) common circulation channel. In either of these cases, the ink of increased viscosity in the vicinity of the nozzles can be ejected efficiently from the ejecting nozzles.

Second Embodiment

Next, a second embodiment of the present invention will be described. Below, portions which are common with the first embodiment are not explained further, and the following description centers particularly on characteristic features of the second embodiment.

Figure 12:
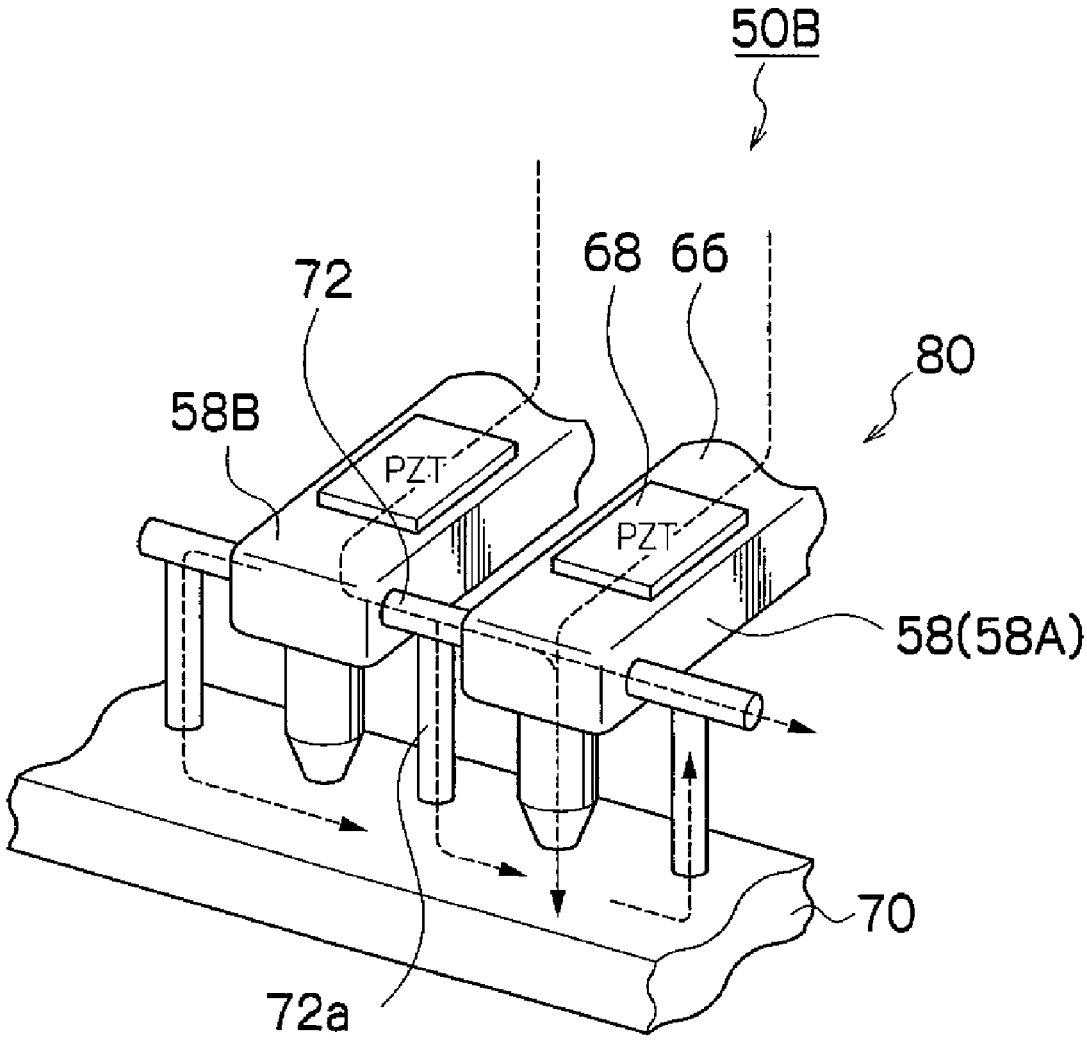
FIG. 12 is an oblique diagram showing a three-dimensional view of the periphery of a pressure chamber in a recording head according to the second embodiment.
Figure 13:
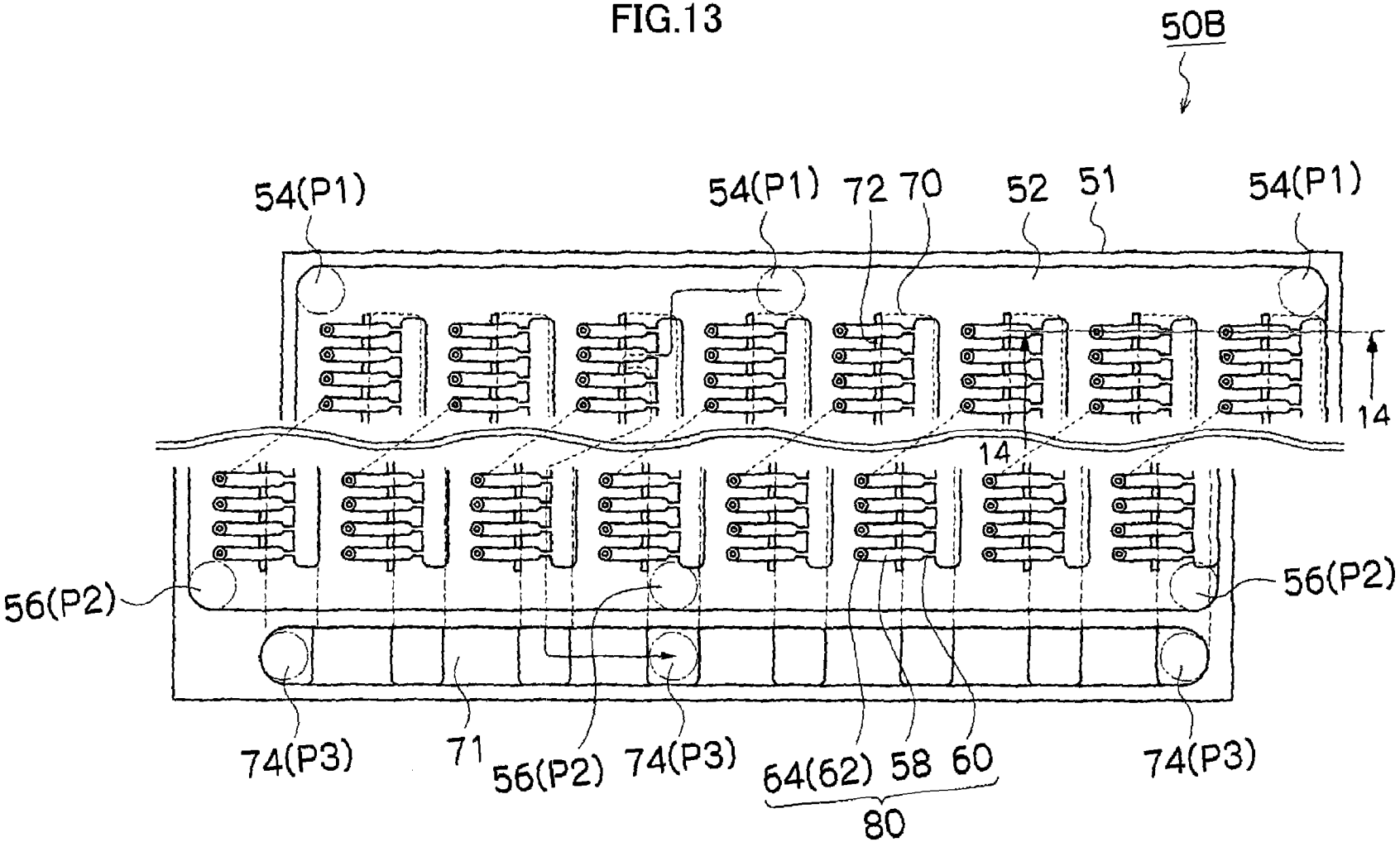
FIG. 13 is a plan diagram showing the detailed composition of a recording head according to the second embodiment.
Figure 14:
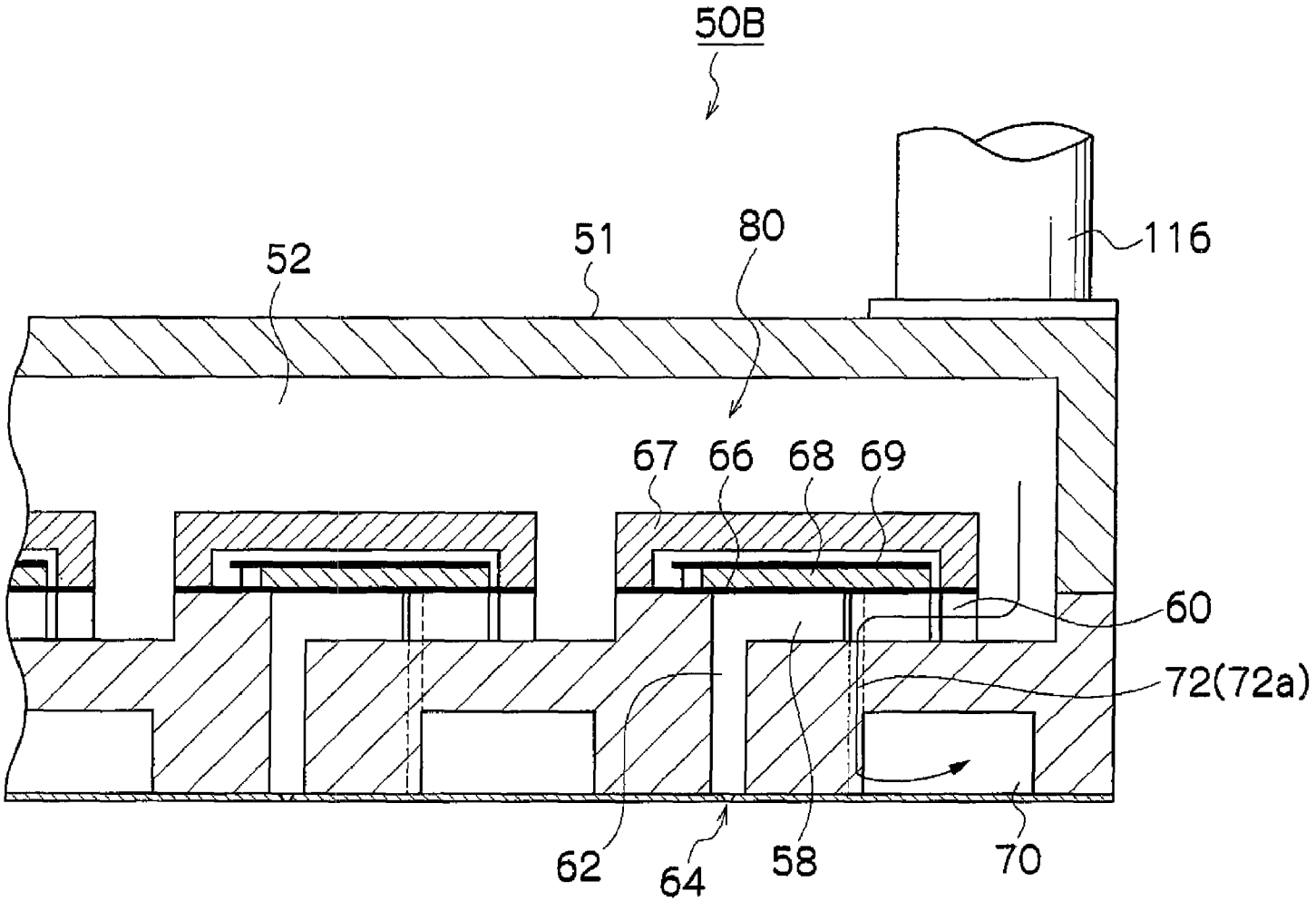
FIG. 14 is a cross-sectional diagram along line 14-14 in FIG. 13.

FIG. 12 is an oblique diagram showing a three-dimensional view of the periphery of a pressure chamber in a recording head according to the second embodiment. FIG. 13 is a plan diagram showing the detailed composition of the recording head according to the second embodiment. FIG. 14 is a cross-sectional diagram showing one portion of a second recording head (a cross-sectional view along line 14-14 in FIG. 13). In FIGS. 12 to 14, parts which are the same as those in FIGS. 5 to 7 are labeled with the same reference numerals.

The second embodiment is the same as the first embodiment except that the second embodiment is different from the first embodiment in respect of the connection arrangement of the individual circulation channels 72. More specifically, in the recording head 50B according to the present embodiment, the mutually adjacent pressure chambers 58A and 58B are connected by a T-shaped individual circulation channel 72 as shown in FIGS. 12 to 14. The branching section 72*a* of this individual circulation channel 72 has an end connected to the common circulation channel 70. The remainder of the composition is the same as that of the first embodiment. The control of ink circulation is also the same as that of the first embodiment.

According to the second embodiment, it is possible efficiently to suppress increase in the ink viscosity inside the pressure chambers 58, even by performing meniscus shaking, and therefore ejection defects can be prevented reliably over a long period of time and greater reliability can be achieved.

Third Embodiment

Next, a third embodiment of the present invention will be described. Below, portions which are common with the first and second embodiments described above are not explained further, and the following description centers on characteristic features of the third embodiment.

Figure 15:
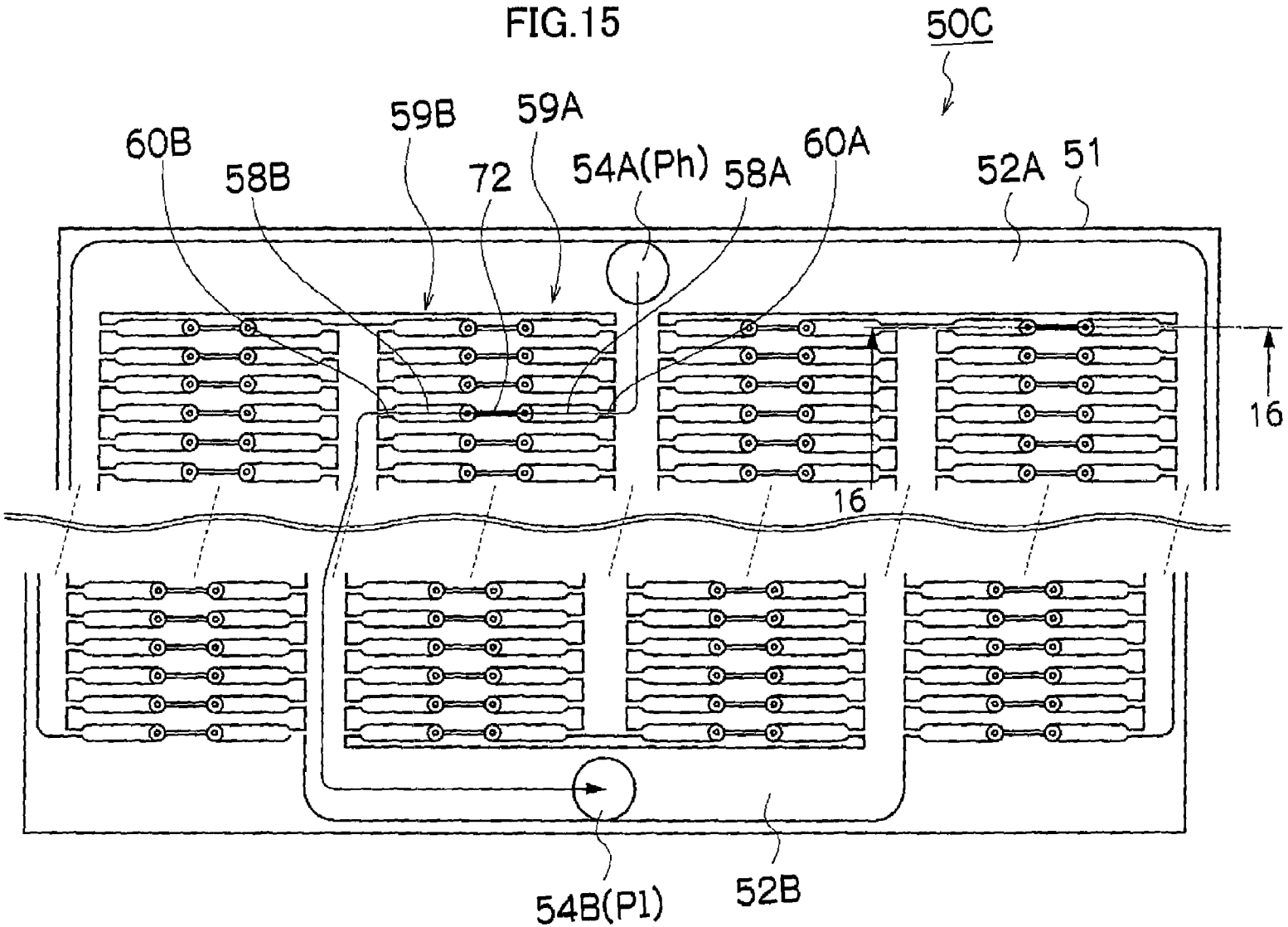
FIG. 15 is a plan diagram showing the detailed composition of a recording head according to a third embodiment.
Figure 16:
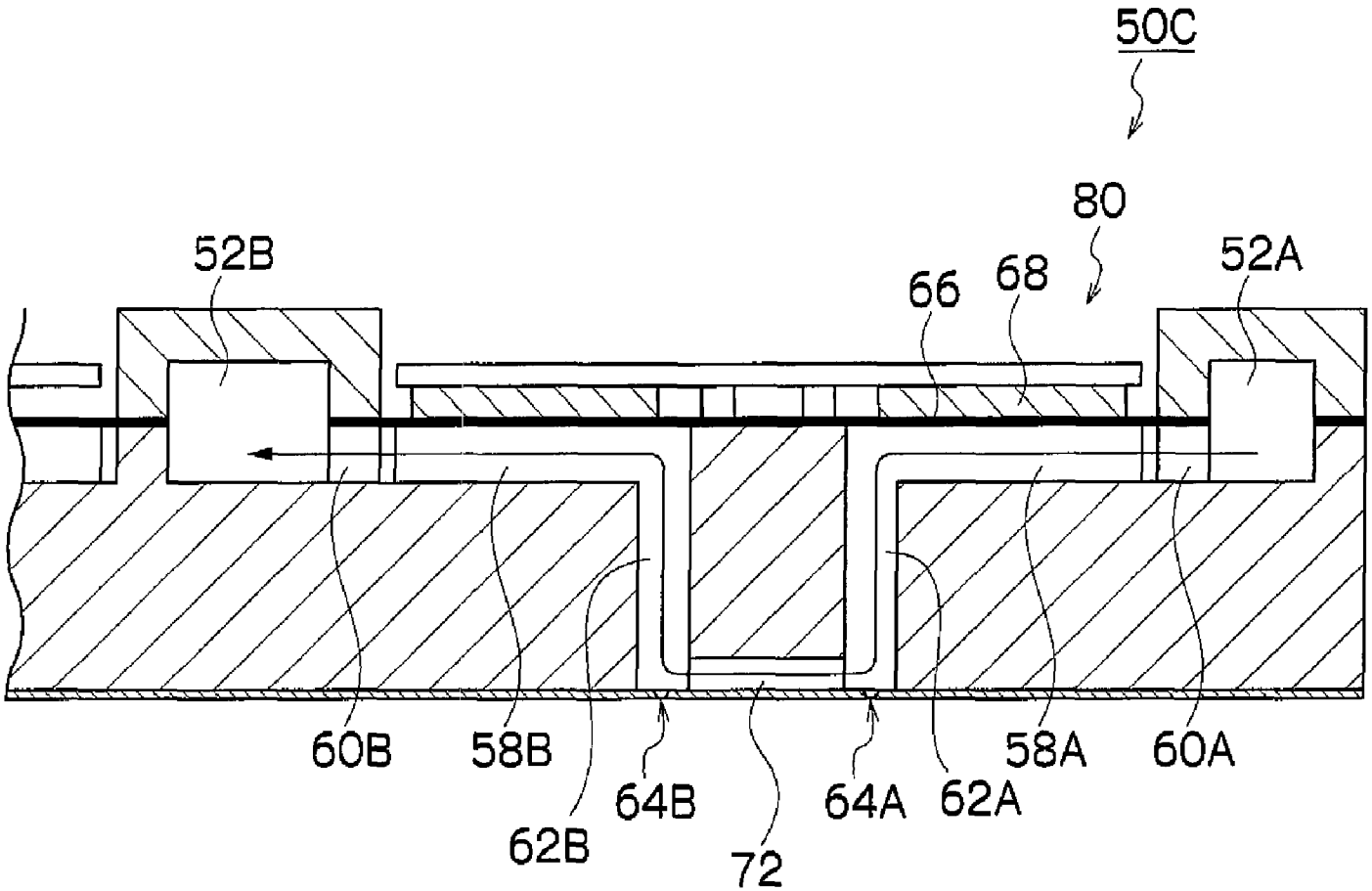
FIG. 16 is a cross-sectional diagram along line 16-16 in FIG. 15.

FIG. 15 is a plan diagram showing the detailed composition of the recording head according to the third embodiment. FIG. 16 is a cross-sectional diagram showing one portion of the recording head according to the third embodiment (a cross-sectional view along line 15-15 in FIG. 16). As shown in FIGS. 15 and 16, in the recording head 50C according to the present embodiment, the pressure chambers 58A and 58B which are mutually opposing are joined together by means of an individual circulation channel 72, and a pressure differential (back pressure differential) is applied between the pressure chambers 58A and 58B, thereby causing ink to circulate from the pressure chamber 58A on the high pressure side, through the individual circulation channel 72, to the pressure chamber on the low pressure side 58B.

More specifically, as shown in FIGS. 15 and 16, the recording head 50C includes a first common flow channel 52A and a second common flow channel 52B, which are mutually separated. The pressure chambers 58A belonging to the first pressure chamber column 59A are respectively connected via the individual supply channels 60A to the first common flow channel 52A. Similarly, the pressure chambers 58B belonging to the second pressure chamber column 59B are connected to the second common flow channel 52B via the individual supply channels 60B, respectively.

As shown in FIG. 16, the individual circulation channel 72 is connected to the nozzle flow channels 62A and 62B which are respectively connected to the mutually opposing pressure chambers 58A and 58B. In other words, the pressure chambers 58A and 58B are connected with each other via the nozzle flow channels 62A and 62B, and the individual circulation channel 72. Of course, there is also a mode in which the pressure chambers 58A and 58B are directly connected via the individual circulation channel 72, without passing via the nozzle flow channels 62A and 62B.

Supply ports 54A and 54B are formed respectively in the first and second common flow channels 52A and 52B, and if the pressure of these supply ports 54A and 54B are taken to be Ph and P1 respectively, then the pressure Ph at the supply port 54A is set or controlled by means of a pump (not illustrated) so as to be higher than the pressure P1 of the supply port 54B (in other words, Ph>P1). More specifically, since the first common flow channel 52A is on the high-pressure side and the second common flow channel 52B is on the low-pressure side, then as indicated by the arrow in FIG. 15, an ink flow is created from the first common flow channel 52A, via the pressure chamber 58A, the individual circulation channel 72 and the pressure chamber 58B, to the second common flow channel 52B.

The pressures Ph and P1 have a relationship of −60 ($mmH_2O$)<P1<Ph<−20 ($mmH_2O$). Due to the pressure differential (Ph-P1) between the pressures Ph and P1, a flow of ink is created from the pressure chamber 58A on the high pressure side to the pressure chamber 58B on the low pressure side.

In the present embodiment, similarly to the first embodiment, taking the resistance of the individual supply channel 60 to be Rs, taking the inertance thereof to be Ls, taking the resistance of the nozzle flow channel 62 to be Rn, taking the inertance thereof to be Ln, taking the resistance of the individual circulation channel 72 to be Rr and taking the inertance thereof to be Lr, (see FIG. 4), then it is preferable that the following conditions are satisfiled:

$$Rs+Rr \approx Rn;$$

$$Ls+Lr \approx Ln;$$

$Rs >> Rr$ ($Rr$ is approximately 1/10 through 1/100 of $Rs$) ; and $Ls >> Lr$ ($Lr$ is approximately 1/10 through 1/100 of $Ls$).

According to the present embodiment, the pressure chambers 58B on the low pressure side function as a common circulation channel. Furthermore, since ink which has increased in viscosity to some extent flows from the pressure chambers 58A on the high pressure side, to the pressure chambers 58B on the low pressure side, then increase in the viscosity can be suppressed by means of greater flow of ink in comparison with the first embodiment. Furthermore, it is also possible to eliminate the space required for installing flow channels for circulating the ink.

Furthermore, if the circulation volume is large, then there is a possibility that some degree of cross-talk (variation in the ejected ink volume) will occur between two opposing pressure chambers 58A and 58B (two pressure chambers 58A and 58B that are mutually connected through one of the individual circulation channels 72), and in this case, it is desirable that the dot arrangement should be selected in such a manner that simultaneous ejection from the two opposing pressure chambers 58A and 58B is avoided as far as possible. The effects of cross-talk are especially visible in low-density to medium-density regions, and therefore simultaneous ejection should be avoided particularly in such regions. Avoiding simultaneous ejection means either ejecting from one pressure chamber only, or performing ink supply to one chamber while ejecting from the other. Alternatively in the step of determining the dot arrangement, a dot arrangement which takes account of this variation in the ink volume may be determined. More specifically, the amount of variation in the ejected ink volume due to cross-talk can be predicted at the design stage, depending on whether both of the two opposing pressure chambers 58A and 58B perform ejection virtually simultaneously, or whether only one chamber performs ejection. The dot arrangement can therefore be determined in accordance with the variation in the ejected ink volume that has been predicted.

Density variations caused by variations in the ink volume are not readily visible in dark solid regions, and therefore the dot arrangements for dark colored lines or text characters (and especially, long lines which extend in the direction of alignment of the two pressure chambers) can be determined without paying particular attention to cross-talk.

Moreover, the present embodiment has been described with reference to an example where two separate common flow channels 52A and 52B are provided, but it is also possible to provide three or more separate common flow channels, provided that a composition is adopted in which a pressure differential is generated between the pressure chambers 58A and 58B which are connected via an individual circulation channel 72.

Fourth Embodiment

Next, a fourth embodiment of the present invention will be described. Below, portions which are common with the first to third embodiments described above are not explained further, and the following description centers on characteristic features of the fourth embodiment.

Figure 17:
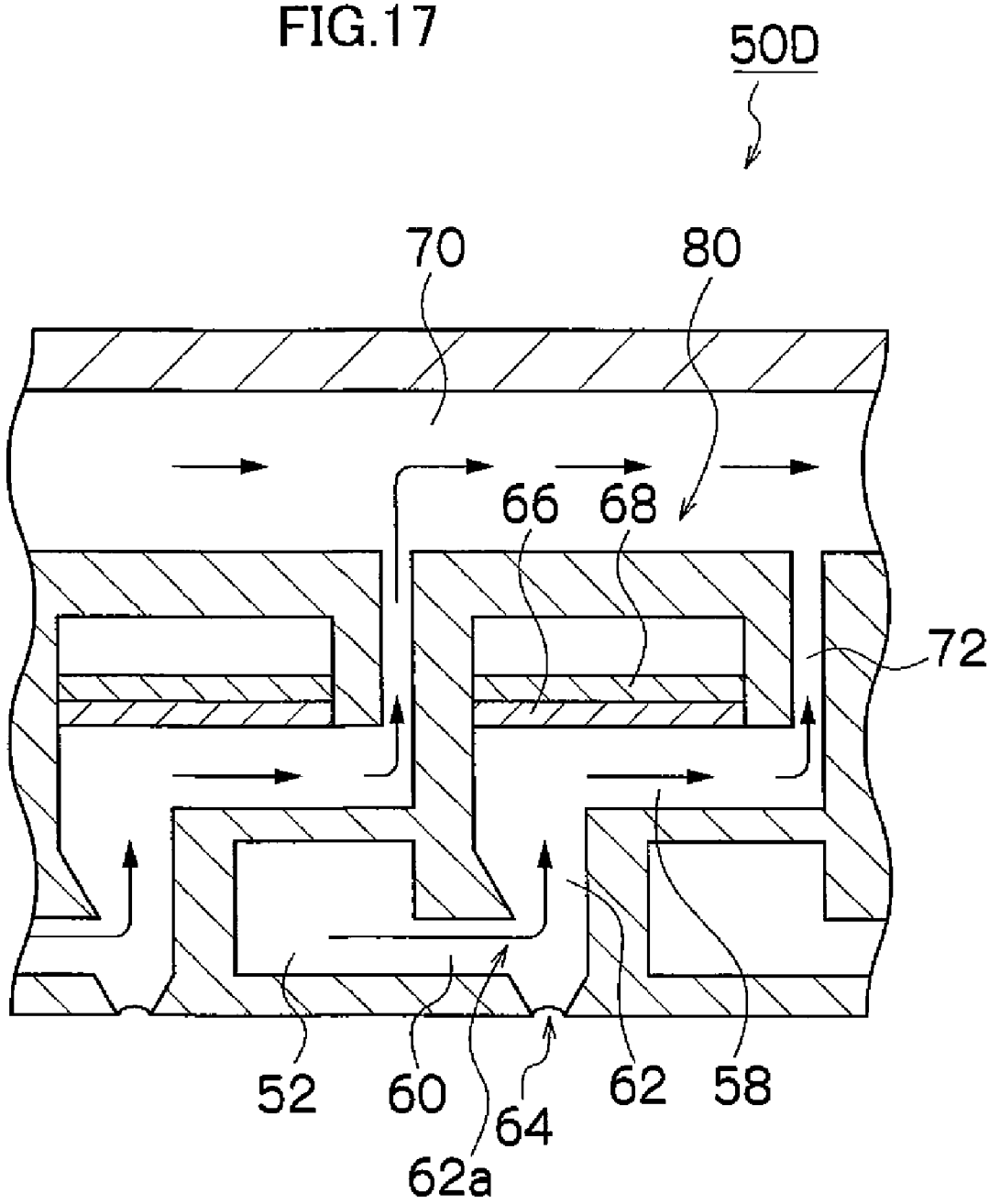
FIG. 17 is a plan diagram showing one portion of a recording head according to a fourth embodiment.

FIG. 17 is a cross-sectional diagram showing one portion of a recording head according to the fourth embodiment. In FIG. 17, parts which are common with FIG. 7 are labeled with the same reference numerals. As shown in FIG. 17, the recording head 50D is according to the present embodiment reverses the arrangement of the common flow channel 52 and the common circulation channel 70, and also reverses the arrangement of the individual supply channel 60 and the individual circulation channel 72 in the recording head 50A according to the first embodiment (see FIG. 7).

In the present embodiment, taking the resistance of the individual supply channel 60 to be Rs, taking the inertance thereof to be Ls, taking the resistance of the nozzle flow channel 62 to be Rn, taking the inertance thereof to be Ln, taking the resistance of the individual circulation channel 72 to be Rr and taking the inertance thereof to be Lr, then it is preferable that the following conditions are satisfied:

$$Rs+Rr \approx Rn;$$

$$Ls+Lr \approx Ln;$$

$Rs << Rr$ ($Rs$ is approximately 1/10 through 1/100 of $Rr$) ; and $Ls << Lr$ ($Ls$ is approximately 1/10 through 1/100 of $Lr$).

According to the fourth embodiment, since ink is supplied from the common flow channel 52 to the vicinity of the nozzles, then increase in the viscosity of the ink in the vicinity of the nozzles is prevented, and furthermore faster ink refilling can be achieved.

Figure 18A:
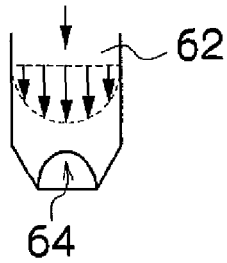
FIGS. 18A to 18E are enlarged cross-sectional diagrams showing an example of the structure of the periphery of the nozzles according to the fourth embodiment.
Figure 18B:
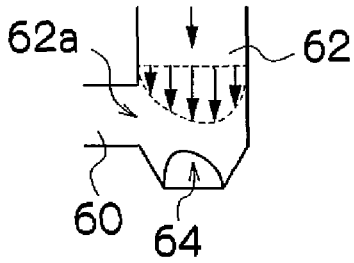

An opening section 62*a* which serves as a connection with the individual supply channel 60 is formed in the nozzle flow channel 62, and hence there is a possibility that the flow speed distribution during ink ejection becomes asymmetrical (i.e., the flow speed distribution is distorted), particularly in cases where this opening section 62*a* is formed in the vicinity of the nozzle. In other words, the flow speed distribution in the nozzle flow channel 62 is symmetrical as shown in FIG. 18A, in a case where the opening section 62*a* is not present in the nozzle flow channel 62. However, the flow speed distribution in the nozzle flow channel 62 is asymmetrical (not symmetrical) as shown in FIG. 18B, in a case where the opening section 62*a* is present in the nozzle flow channel 62. The asymmetry of the flow speed distribution occurs due to the effects of the change in the flow speed caused by the presence or absence of the side wall, and the compressibility of the ink which depends on the volume of the nozzle flow channel 62. Due to these effects, a phenomenon occurs whereby a portion of the ink is pushed away from the individual supply channel 60 side and the meniscus surface is distorted toward the side of the opening section 62*a*.

Figure 18C:
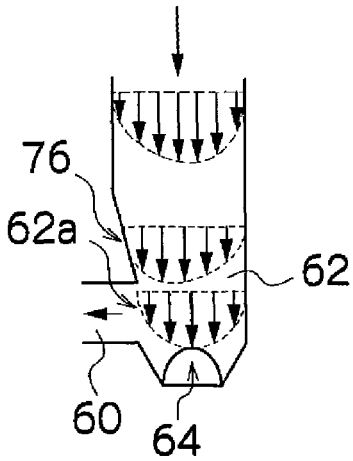
Figure 18D:
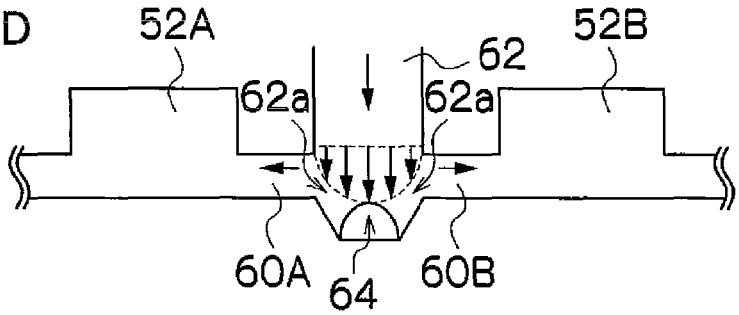
Figure 18E:
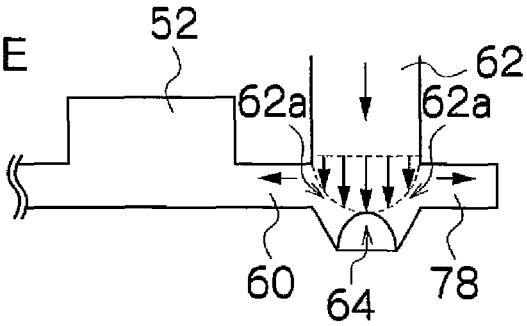

In order to resolve problems of this kind, compositional examples such as those shown in FIGS. 18C to 18E may be adopted.

FIG. 18C is a diagram showing an example where a flow speed regulating restrictor section 76 is provided between the pressure chamber 58 and the opening section 62*a*. In other words, the flow speed regulating restrictor section 76 is provided on the ink inlet side (i.e., on the pressure chamber 58 side; the upper side in FIG. 18C) of the opening section 62*a* in the nozzle flow channel 62. The nozzle flow channel 62 tapers in the flow speed regulating restrictor section 76 toward the nozzle 64. In other words, the flow speed regulating restrictor section 76 has a cross-sectional area which becomes gradually small toward the ink ejection side (nozzle 64 side; the lower side in FIG. 18C). In the compositional example shown in FIG. 18C, the flow speed on the side of the flow speed regulating restrictor section 76 becomes greater compared to a case where the flow speed regulating restrictor section 76 is not provided (FIG. 18B), and the distortion of the flow speed distribution can be suppressed after passing the flow speed regulating restrictor section 76. Consequently, it is possible to achieve a flow speed distribution which is substantially symmetrical with respect to the nozzle axis.

FIGS. 18D and 18E are diagrams showing farther examples in which a plurality of openings (i.e., opening sections 62*a*) are arranged on an inner surface of the nozzle flow channel 62. In FIG. 18D, two opening sections 62*a* and 62*a* are formed in the nozzle flow channel 62 at the connections for the two individual supply channels 60A and 60B. Although the individual supply channels 60A and 60B are connected to mutually different common flow channels 52A and 52B, they may be connected to the same individual supply channel. FIG. 18E shows a case where one opening section 62*a* is formed by the individual supply channel 60 which is connected to the nozzle flow channel 62, and furthermore, another opening section 62*a* is formed by means of a depression 78 provided in a portion of the nozzle flow channel 62. The composition shown in FIG. 18E is effective, for example, in cases where the composition shown in FIG. 18D cannot be adopted due to space restrictions. In both cases, it is desirable that the two opening sections 62*a* and 62*a* formed in the nozzle flow channel 62 should be formed at mutually opposing positions. Furthermore, it is also possible for there to be three or more opening sections 62*a* formed in the nozzle flow channel 62, and in this case, it is desirable that the three or more opening sections 62*a* should be arranged at positions that are rotationally-symmetric in terms of an axis of the nozzle 64. For example, although not shown in the drawings, a mode is possible in which three opening sections 62*a*, 62*a* and 62*a* are formed by means of two individual supply channels 60A and 60B, and a depression 78. According to these examples, it is possible to achieve symmetry regardless of the presence or absence of side walls, and of the compressibility, and therefore a flow speed distribution which is not distorted and which is substantially symmetrical in terms of the nozzle axis can be achieved.

The compositions shown in FIGS. 18C to 18E are not limited to a mode where the individual supply channel 60 is connected to the nozzle flow channel 62 as in the present embodiment, and they may also be applied suitably to a mode where the individual circulation channel 72 is connected to the nozzle flow channel 62, as in the first embodiment.

Fifth Embodiment

Next, a fifth embodiment of the present invention will be described. Below, portions which are common with the first to fourth embodiments described above are not explained further, and the following description centers on characteristic features of the fifth embodiment.

In the fifth embodiment, ink circulation control of the following kind is implemented in the recording head 50A similar to the first embodiment.

When not ejecting (when the ink ejection volume X=0) (see FIG. 10), then similarly to the first embodiment, the pressure P3 is set so as to satisfy the following conditions:

$$-(P2-P3)/(Rs+Rr)=I,$$

where I is the minimum ink ejection volume required to prevent ejection defects and corresponds to the ink ejection volume $X_1$ shown in FIG. 10.

On the other hand, during ejection (when the average ejection rate Ia>0), the following relationship is satisfied:

$$P3=(Ia/X_4)(P2-P3_n)+P3_n,$$

where $P3_n$ is the value of P3 during non-ejection.

By setting the pressures P1, P2 and P3 in this way, in FIG. 10, the relationship between the ink ejection volume X and the ink supply volume Y assumes the relationship indicated by the line 208 which directly links the point $Y_1$ on the vertical axis with the point c.

According to the present embodiment, the ink supply volume is made greater than the ink ejection volume, and furthermore, a differential between the ink supply volume and the ink ejection volume is reduced (i.e., the ink supply volume approaches the ink ejection volume) as the ink ejection volume increases. The ink circulation volume may be controlled so as to be inversely proportional to the ink ejection volume. In this case, since the ink circulation can be controlled so as to be inversely proportional to the number of printed dots, for example, then the control procedure can be simplified.

Although the liquid circulation apparatus, the image forming apparatus and the liquid circulation method according to the present invention have been described in detail above, the present invention is not limited to the aforementioned embodiments, and it is of course possible for improvements or modifications of various kinds to be implemented, within a range which does not deviate from the essence of the present invention.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid circulation apparatus, comprising:

a plurality of liquid ejection elements each of which includes: a nozzle; a pressure chamber which is connected to the nozzle and accommodates liquid; and a piezoelectric element which displaces a wall of the pressure chamber to eject the liquid in the pressure chamber through the nozzle;

a plurality of individual supply channels which are respectively connected to the liquid ejection elements;

a common supply channel which is connected to the individual supply channels, the liquid being supplied from the common supply channel to the liquid ejection elements through the individual supply channels;

a plurality of individual circulation channels which are respectively connected to the liquid ejection elements;

a common circulation channel which is connected to the individual circulation channels, the liquid being circulated from the liquid ejection elements to the common circulation channel through the individual circulation channels; and a control device which controls a circulation volume of the liquid circulated from the liquid ejection elements to the common circulation channel, by adjusting a supply volume of the liquid supplied from the common supply channel to the liquid ejection elements in accordance with an ejection volume of the liquid ejected from the liquid ejection elements.

2. The liquid circulation apparatus as defined in claim 1, wherein the control device adjusts the supply volume by changing a pressure differential of the liquid between in the common supply channel and in the common circulation channel.

3. The liquid circulation apparatus as defined in claim 1, wherein the control device adjusts the supply volume to be greater than the ejection volume when the ejection volume is smaller than a prescribed value, and adjusts the supply volume to be equal to the ejection volume when the ejection volume is greater than the prescribed value.

4. The liquid circulation apparatus as defined in claim 3, wherein when the ejection volume is smaller than the prescribed value, the control device keeps the supply volume constant regardless of the ejection volume.

5. The liquid circulation apparatus as defined in claim 3, wherein when the ejection volume is smaller than the prescribed value, the control device adjusts the supply volume to increase gradually as the ejection volume increases.

6. The liquid circulation apparatus as defined in claim 1, wherein the control device adjusts the supply volume to be greater than the ejection volume but to approach the ejection volume gradually as the ejection volume increases.

7. The liquid circulation apparatus as defined in claim 1, wherein:

each of the liquid ejection elements further includes a nozzle channel which connects the pressure chamber with the nozzle;

one of the individual supply channels is connected to the pressure chamber; and one of the individual circulation channels has an opening end which opens to the nozzle channel.

8. The liquid circulation apparatus as defined in claim 1, wherein:

each of the liquid ejection elements further includes a nozzle channel which connects the pressure chamber with the nozzle;

one of the individual supply channels has an opening end which opens to the nozzle channel; and one of the individual circulation channels is connected to the pressure chamber.

9. The liquid circulation apparatus as defined in claim 7, wherein the nozzle channel has a flow speed regulating section between the pressure chamber and the opening end of the one of the individual circulation channels, the nozzle channel tapering in the flow speed regulating section toward the nozzle.

10. The liquid circulation apparatus as defined in claim 8, wherein the nozzle channel has a flow speed regulating section between the pressure chamber and the opening end of the one of the individual supply channels, the nozzle channel tapering in the flow speed regulating section toward the nozzle.

11. The liquid circulation apparatus as defined in claim 7, wherein the nozzle channel is defined by an inner surface having a plurality of openings including the opening end of the one of the individual circulation channels, the openings being arranged at positions that are rotationally-symmetric in terms of an axis of the nozzle.

12. The liquid circulation apparatus as defined in claim 8, wherein the nozzle channel is defined by an inner surface having a plurality of openings including the opening end of the one of the individual supply channels, the openings being arranged at positions that are rotationally-symmetric in terms of an axis of the nozzle.

13. The liquid circulation apparatus as defined in claim 1, wherein each of the individual flow channels has a branching section which has a first end connected to the common circulation channel and a second end connected to at least two of the liquid ejection elements.

14. A liquid circulation apparatus, comprising:

a plurality of pairs of first and second liquid ejection elements, each of the first and second liquid ejection elements including: a nozzle; a pressure chamber which is connected to the nozzle and accommodates Liquid; and a piezoelectric element which displaces a wall of the pressure chamber to eject the liquid in the pressure chamber through the nozzle;

a plurality of first individual supply channels which are respectively connected to the first liquid ejection elements;

a first common supply channel which is connected to the first individual supply channels;

a plurality of second individual supply channels which are respectively connected to the second liquid ejection elements;

a second common supply channel which is connected to the second individual supply channels;

a plurality of individual circulation channels each of which connects the first and second liquid ejection elements with each other in one of the pairs of the first and second liquid ejection elements; and a control device which controls a pressure differential of the liquid between in the first common channel and in the second common channel according to an ejection volume of the liquid ejected from the liquid ejection elements.

15. An image forming apparatus comprising the liquid circulation apparatus as defined in claim 1.

16. An image forming apparatus comprising the liquid circulation apparatus as defined in claim 14.

17. A liquid circulation method for a liquid circulation apparatus which includes: a plurality of liquid ejection elements each of which includes a nozzle, a pressure chamber which is connected to the nozzle and accommodates liquid, and a piezoelectric element which displaces a wall of the pressure chamber to eject the liquid in the pressure chamber through the nozzle; a plurality of individual supply channels which are respectively connected to the liquid ejection elements; a common supply channel which is connected to the individual supply channels, the liquid being supplied from the common supply channel to the liquid ejection elements through the individual supply channels; a plurality of individual circulation channels which are respectively connected to the liquid ejection elements; and a common circulation channel which is connected to the individual circulation channels, the liquid being circulated from the liquid ejection elements to the common circulation channel through the individual circulation channels, the method comprising the steps of:

determining an ejection volume of the liquid ejected from the liquid ejection elements; and controlling a circulation volume of the liquid circulated from the liquid ejection elements to the common circulation channel, by adjusting a supply volume of the liquid supplied from the common supply channel to the liquid ejection elements in accordance with the ejection volume determined in the determining step.

* * * * *